US009962895B2

(12) United States Patent
Ponti

(10) Patent No.: US 9,962,895 B2
(45) Date of Patent: May 8, 2018

(54) METHOD FOR REALISING CARTONS FOR PACKING AND AN APPARATUS ACTUATING THE METHOD

(71) Applicant: F.L. AUTO S.r.l., Rome (IT)

(72) Inventor: Giuseppe Ponti, Cerbara-Città di Castello (IT)

(73) Assignee: F.L. AUTO S.r.L., Rome (IT)

( * ) Notice: Subject to any disclaimer, the term of this patent is extended or adjusted under 35 U.S.C. 154(b) by 464 days.

(21) Appl. No.: 14/423,958

(22) PCT Filed: Aug. 28, 2013

(86) PCT No.: PCT/IB2013/058048

§ 371 (c)(1),
(2) Date: Feb. 25, 2015

(87) PCT Pub. No.: WO2014/033635

PCT Pub. Date: Mar. 6, 2014

(65) Prior Publication Data

US 2015/0224731 A1 Aug. 13, 2015

(30) Foreign Application Priority Data

Aug. 31, 2012 (IT) ..... BO2012A0463

(51) Int. Cl.
*B31B 1/20* (2006.01)
*B31B 1/16* (2006.01)
(Continued)

(52) U.S. Cl.
CPC ..... *B31B 1/20* (2013.01); *B65B 11/004* (2013.01); *B65B 57/12* (2013.01); *B65D 5/2095* (2013.01);
(Continued)

(58) Field of Classification Search
CPC ..... B26D 1/626; B65B 57/12; B65D 5/2095; B31B 3/00; B31B 50/16; B31B 50/622;
(Continued)

(56) References Cited

U.S. PATENT DOCUMENTS 1,809,853 A * 6/1931 Knowlton ..... B31B 50/00 229/190
1,913,055 A * 6/1933 Keller ..... B31B 50/00 156/217
(Continued)

FOREIGN PATENT DOCUMENTS

EP 2392450 A1 * 12/2011 ..... B31B 1/00
FR 2411700 A1 7/1979
(Continued)

*Primary Examiner* — Hemant M Desai
*Assistant Examiner* — Lucas Palmer
(74) *Attorney, Agent, or Firm* — R. Neil Sudol; Henry D. Coleman

(57) ABSTRACT

A method and an apparatus for realizing cartons for packing includes feeding a cardboard band (2) for packing along an advancement direction (A) which is parallel to the development direction of the cardboard band (2) and making a first score line (II) and a second score line (12) on the cardboard band (2), so as: to identify a central sector; a first lateral sector (4), and a second lateral sector (5). The method further includes identifying regions of band (8) on the carton (2), making on each region of band (8) at least a first cut (21), a second cut (22), a third cut (23) and a fourth cut (24) oriented transversally so that a first closing wing (49), a first reinforcing wing (51) a second reinforcing wing (52), a second closing wing (50), a third reinforcing wing (53) and a fourth reinforcing wing (54) are defined. The band of carton (2) is cut transversally so as to separate the regions of band (8) from one another, thus obtaining cartons (I) for packing.

6 Claims, 13 Drawing Sheets

(51) Int. Cl.

| | |
|---|---|
| ***B31B 1/25*** | (2006.01) |
| ***B65D 5/20*** | (2006.01) |
| ***B65B 57/12*** | (2006.01) |
| ***B65B 11/00*** | (2006.01) |
| *B31B 50/16* | (2017.01) |
| *B31B 50/22* | (2017.01) |
| *B31B 50/81* | (2017.01) |
| *B31B 100/00* | (2017.01) |
| *B31B 50/25* | (2017.01) |
| *B31B 50/62* | (2017.01) |
| *B31B 110/35* | (2017.01) |
| *B31B 120/10* | (2017.01) |
| *B31B 120/00* | (2017.01) |

(52) U.S. Cl.
CPC ..... *B31B 50/16* (2017.08); *B31B 50/22* (2017.08); *B31B 50/256* (2017.08); *B31B 50/622* (2017.08); *B31B 50/81* (2017.08); *B31B 2100/00* (2017.08); *B31B 2100/0026* (2017.08); *B31B 2110/35* (2017.08); *B31B 2120/004* (2017.08); *B31B 2120/102* (2017.08); *B31B 2120/502* (2017.08); *B65B 2210/04* (2013.01)

(58) Field of Classification Search
CPC . B31B 2120/502; B31B 50/22; B31B 50/256; B31B 2110/35; B31B 50/81; B31B 2100/00
USPC ..... 493/59, 60, 69, 79
See application file for complete search history.

(56) References Cited

U.S. PATENT DOCUMENTS 2,015,202 A * 9/1935 Stokes ..... B31B 70/00 493/110
2,382,573 A * 8/1945 Moore ..... B65D 5/62 229/5.81
2,395,352 A * 2/1946 Staude ..... B31F 1/10 101/225
2,431,697 A * 12/1947 La Grua ..... B65D 3/04 229/4.5
2,799,211 A * 7/1957 Zerlin ..... B31B 50/00 493/129
3,147,676 A * 9/1964 Sheeran ..... B31B 1/00 493/403
3,163,095 A * 12/1964 Sheeran ..... B31B 50/00 493/352
3,529,516 A * 9/1970 Pullen ..... B65D 5/4266 229/5.85
4,177,715 A * 12/1979 Meyers ..... B65D 5/48024 493/59
4,631,895 A * 12/1986 Ghiretti ..... B65B 11/10 53/207
5,558,611 A * 9/1996 Focke ..... B31B 50/00 493/162
5,904,643 A * 5/1999 Seeberger ..... B31B 70/00 425/351
6,349,526 B1 * 2/2002 Newman ..... B07C 5/10 53/143
6,468,375 B1 * 10/2002 Hamblin ..... B65D 5/0005 156/211
6,478,725 B1 * 11/2002 Bengt ..... B26D 1/245 493/59
7,788,883 B2 * 9/2010 Buckley ..... G06Q 30/06 382/154
8,961,380 B2 * 2/2015 Langen ..... B31B 1/06 493/127
9,409,664 B1 * 8/2016 Vliet ..... B65B 59/00
2004/0060264 A1 * 4/2004 Miller ..... B65B 11/18 53/461
2007/0042885 A1 * 2/2007 Rietjens ..... B23K 26/0846 493/59
2007/0232472 A1 * 10/2007 Ludovissie ..... B65D 5/321 493/69
2008/0020916 A1 * 1/2008 Magnell ..... B65B 5/02 493/65
2009/0062094 A1 * 3/2009 Inoue ..... B26D 3/14 493/60
2010/0011924 A1 * 1/2010 Bernreuter ..... B26D 1/245 83/39
2011/0152048 A1 * 6/2011 Gombert ..... B23K 26/0648 493/53
2012/0042614 A1 * 2/2012 Jannin ..... B65B 11/004 53/443
2012/0100976 A1 * 4/2012 Graham ..... B31B 3/00 493/52
2013/0000252 A1 * 1/2013 Pettersson ..... B65B 5/024 53/396
2013/0029823 A1 * 1/2013 Zoeckler ..... B65D 5/445 493/55
2013/0045847 A1 * 2/2013 Capoia ..... B26D 7/2635 493/59
2013/0070085 A1 * 3/2013 Boulanger ..... G01G 19/005 348/135
2013/0225383 A1 * 8/2013 Toro ..... B31B 17/00 493/56
2013/0267397 A1 * 10/2013 Hoover ..... B31B 1/14 493/17
2015/0148210 A1 * 5/2015 Sibthorpe ..... B31B 1/88 493/324
2015/0174850 A1 * 6/2015 McMahon ..... B65D 5/3621 493/59
2015/0225110 A1 * 8/2015 Ponti ..... B65D 5/20 53/456
2016/0176562 A1 * 6/2016 Pettersson ..... B65B 43/08 53/452
2016/0185475 A1 * 6/2016 Pettersson ..... B65B 59/02 53/493
2016/0340067 A1 * 11/2016 Winkler ..... B65B 35/50
2017/0057190 A1 * 3/2017 Toro ..... B31B 1/16

FOREIGN PATENT DOCUMENTS

GB 1083889 A 9/1967
JP 2011152982 * 6/2011

* cited by examiner

FIG.3A
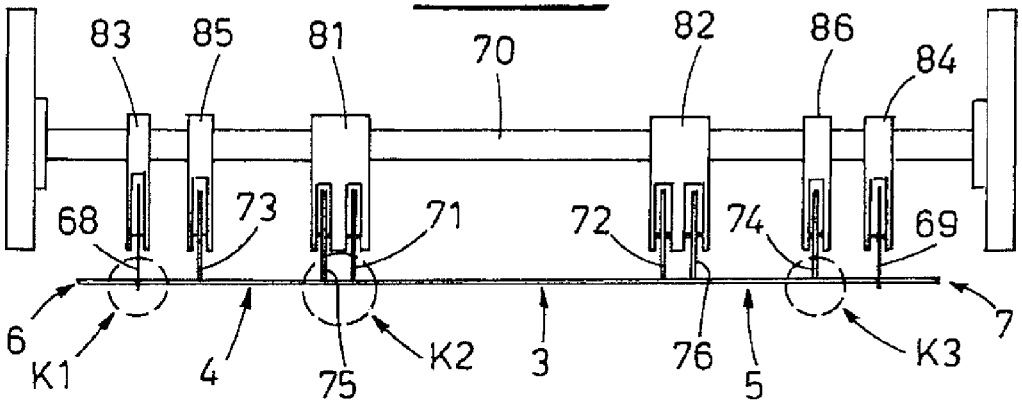
FIG.4
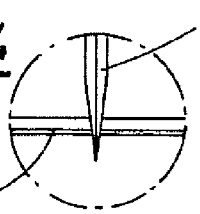
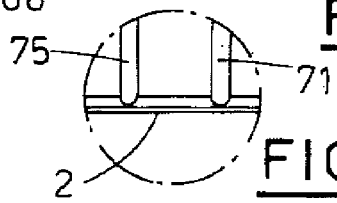
FIG.5
FIG.6
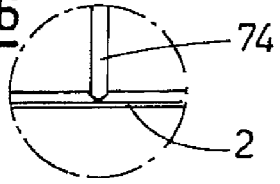
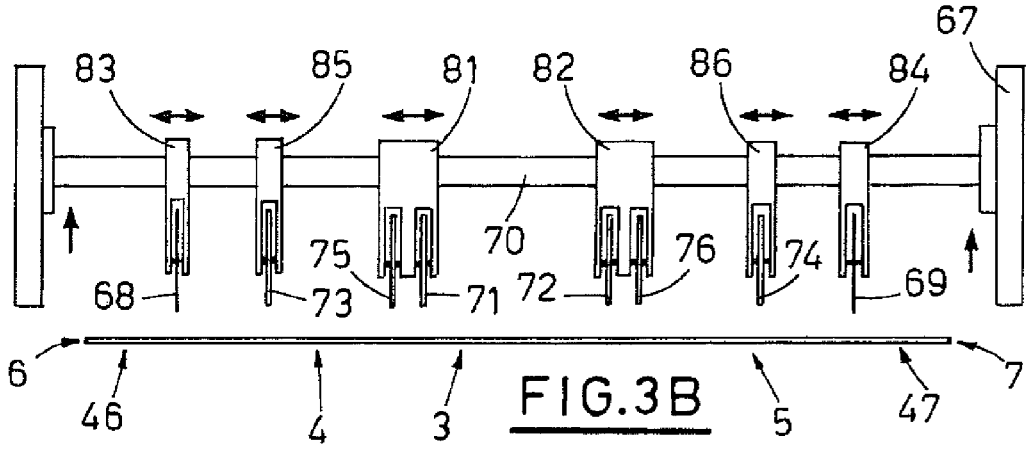
FIG.3B
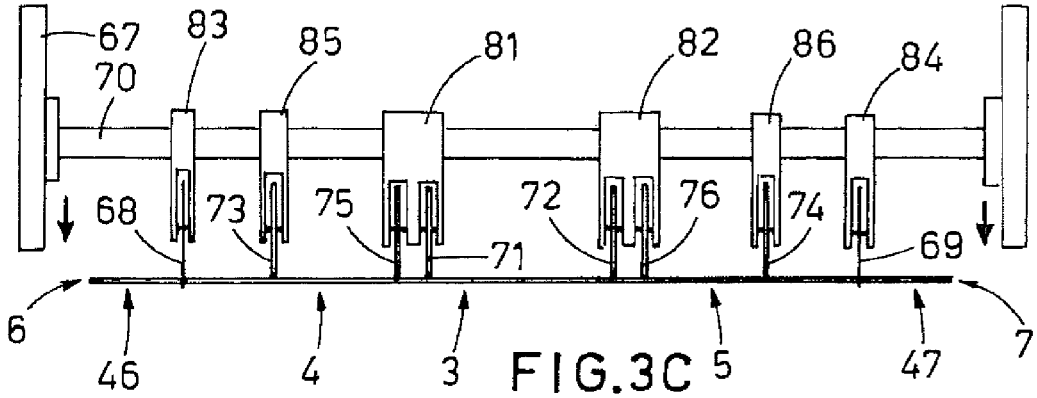
FIG.3C A
XI
XI
39
20
55
35
56
31
49
4
32
59
37
60
109
100
38
99
34
50
5
33
36
58
57
48
39
20
8
4
21
25
22
27
13
15
109
16
14
28
24
5
23
26
48
48
39

METHOD FOR REALISING CARTONS FOR PACKING AND AN APPARATUS ACTUATING THE METHOD

FIELD OF INVENTION

The present invention relates to the technical sector relating to packing of articles, such as books, dvd packs, reams of paper and the like. In particular the invention relates to a method for realizing cartons for packing and an apparatus actuating the method.

DESCRIPTION OF THE PRIOR ART

At present a dispatch company of articles has to regularly acquire cartons for packing the articles to be dispatched and have stores dimensioned so as to stock large quantities of cartons for packing. This complicates the logistics and requires the use of stores of notable dimensions.

SUMMARY OF THE INVENTION

The aim of the present invention consists in obviating the above-mentioned drawbacks.

With the present invention, cartons for packing can be realised directly at the point of work, using for example reels of cardboard for packing from which the cardboard band can be unreeled to obtain large quantities of cartons for packing. The space required for actuating the method and for storing the reels has been seen to be lower than the space required for storing, in the prior art, packing cartons produced elsewhere; further, and advantageously, the logistics are simplified and the unit cost for each packing carton is significantly reduced, as the cartons can now be produced internally of the dispatch company.

According to claim 2, packing cartons can be made to measure for the articles to be dispatched; the cartons can have various dimensions and type.

In the known art, however, dispatch companies also had to have available packing cartons of different dimensions so as to adapt to the dimensions of the articles to be dispatched. As an article to be dispatched can be of various sizes, an operator had to choose, for the article, the most suitable cartons in terms of dimensions; the carton was then manipulated so as to assume a box shape and the article inserted in the box thus-formed, together with filler material (e.g. polystyrene) which absorbed any impacts to the article during transport. These operations were expensive in terms of time and material used: in fact, the measurements of the packing carton were almost never optimal but were greater with respect to those of a packing carton made to measure for the article to be dispatched; further, the greater dimensions of the packing carton with respect to the article to be sent have to be compensated-for with the use of filler material so as to occupy the empty spaces between the article and the box containing it.

BRIEF DESCRIPTION OF THE DRAWINGS

Specific embodiments of the invention will be described in the following part of the present description, in accordance with what is set down in the claims and with the aid of accompanying tables of drawings, in which:

FIGS. 3A, 3B, 3C are frontal views of a unit comprising scoring and cutting wheels and illustrated in FIG. 2, respectively during an operating step, a regulating step and a following operating step;

FIGS. 4, 5, 6 are respectively larger-scale views of details K1, K2, K3 of FIG. 3A;

DESCRIPTION OF PREFERRED EMBODIMENTS

Figure 1:
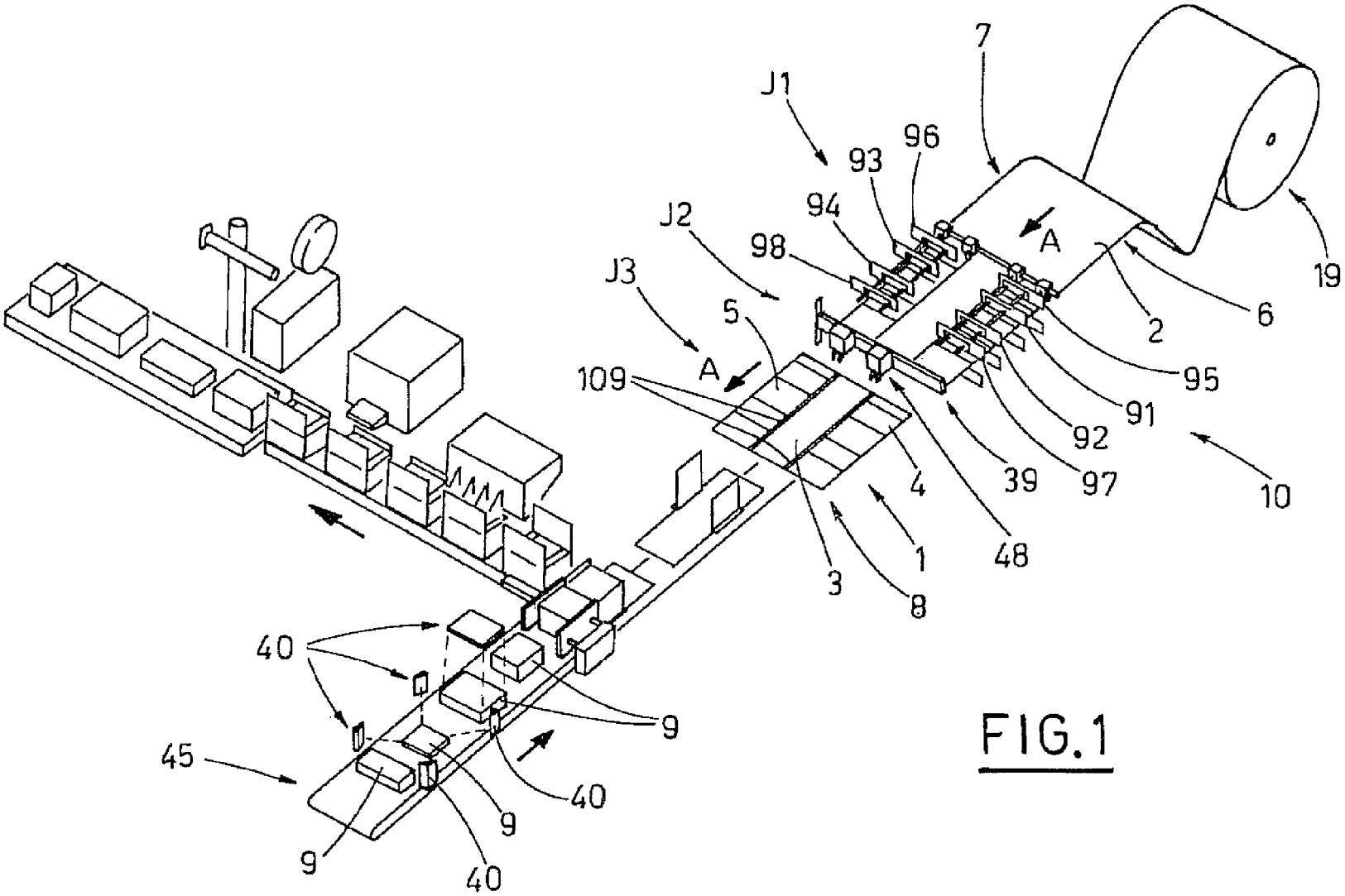
FIG. 1 is a perspective view in small-scale which illustrates a system for packing articles in an automated way, which system comprises the apparatus of the invention.
Figure 2:
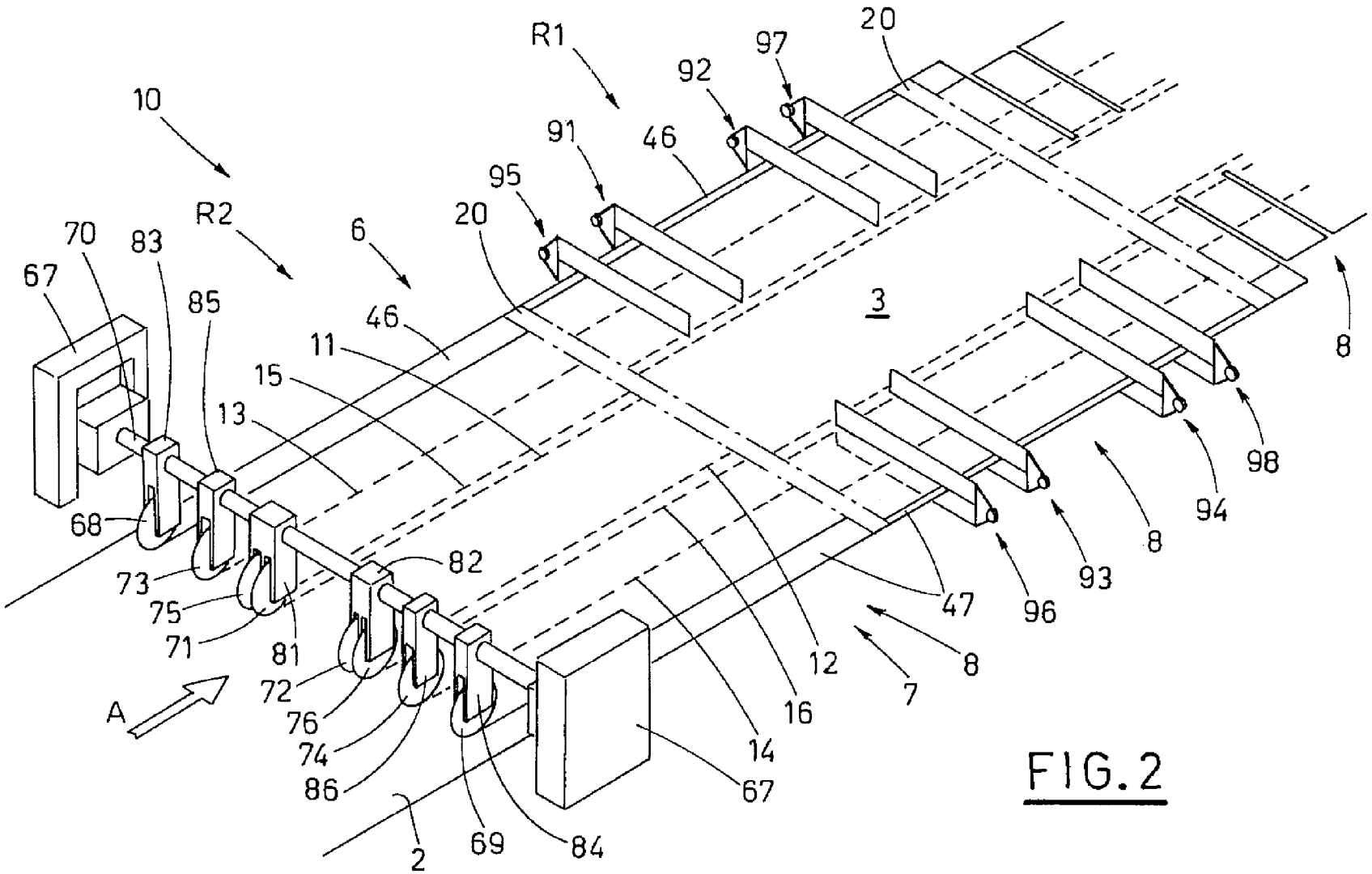
FIG. 2 is a perspective view of a part of the apparatus of FIG. 1, denoted by reference J1 in FIG. 1.
Figures 12A, 12B:
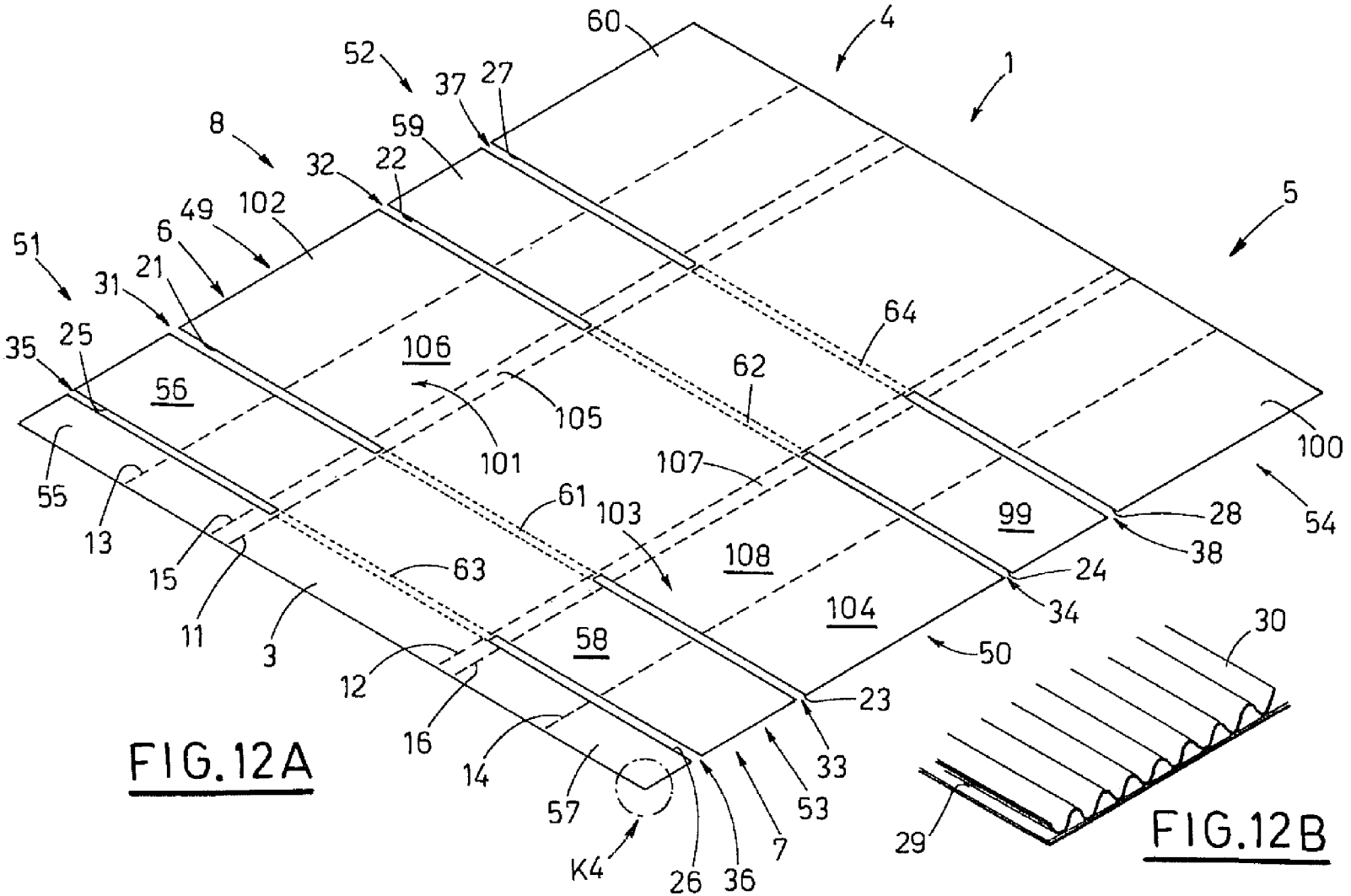
FIG. 12A is a perspective view of a packing carton obtained with the apparatus of FIG. 1, which packing carton is denoted with reference J3 in FIG. 1.
FIG. 12B is a larger-scale view of detail K4 of FIG. 12A.
Figure 12C:
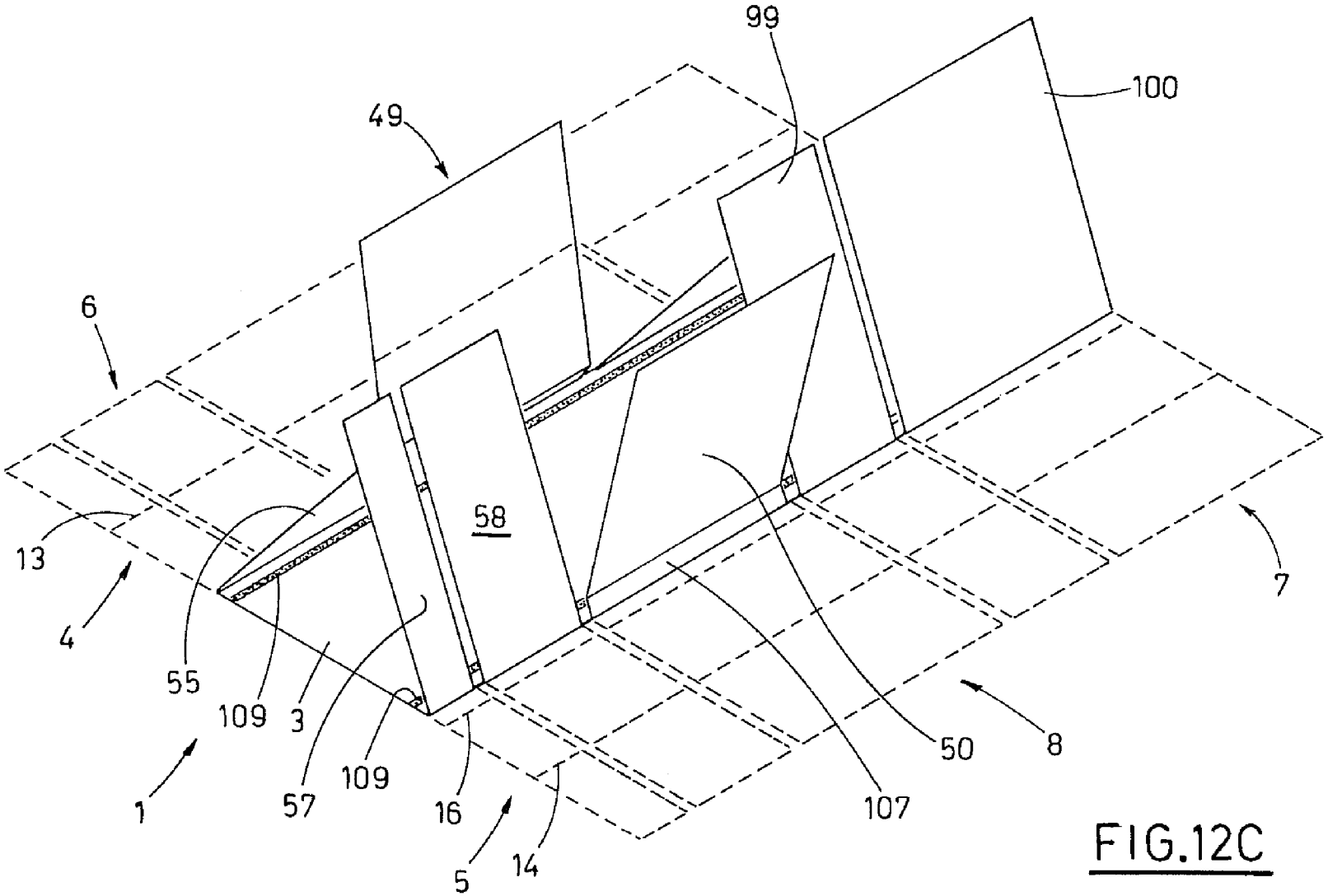
FIG. 12C is a perspective view of a first folding step of a first packing carton.

The method for realising cartons (1) for packing comprises, in its essential aspects, steps of:

a) feeding a cardboard band (2) for packing along an advancement direction (A) which is parallel to the development direction of the cardboard band (2); (FIG. 1);

b) making a first score line (11) and a second score line (12) on the cardboard band (2) (FIGS. 2, 3A-3B), such that the first score line (11) and the second score line (12) are parallel to the development direction and the following are identified: a central sector (3) comprised between the first score line (11) and the second score line (12); a first lateral sector (4) comprised between the first score line (11) and a first lateral end (6) of the cardboard band (2); and a second lateral sector (5) comprised between the second score line (12) and a second lateral end (7) of the cardboard band (2) which is opposite the first lateral end (6)(FIGS. 2, 12A);

c) identifying regions (8) on the cardboard band (2) band (in the following referred-to as regions that are consecutive to one another (FIG. 2);

d) carrying out, on each band region (8), at least a first cut (21), a second cut (22), a third cut (23) and a fourth cut (24) made in a transversal direction to the development direction of the cardboard band (2) such that: the first cut (21) and the second cut (22) are performed on the first lateral sector (4) and extend up to the first score line (11), such that a first closing wing (49), a first reinforcing wing (51) and a second reinforcing wing (52) are defined in the first lateral sector (4), the first closing wing (49) being interposed between the first reinforcing wing (51) and the second reinforcing wing (52); the third cut (23) and the fourth cut (24) are performed on the second lateral sector (5) and extend up to the second score line (12), such that a second closing wing (50), a third reinforcing wing (53) and a fourth reinforcing wing (54) are defined on the second lateral sector (5), the second closing wing (50) being interposed between the third reinforcing wing (53) and the fourth reinforcing wing (54); the first closing wing (49) is opposite the second closing wing (50), the first reinforcing ring (51) is opposite the third reinforcing wing (53), the second reinforcing wing (52) is opposite the fourth reinforcing wing (54);

e) cutting (FIGS. 10A, 10B, 11) the cardboard band (2) transversally such as to separate the above-cited band regions (8) from one another, thus obtaining cartons (1) for packing.

The above steps are performed on the band of carton (2) so that each carton (1) for packing obtained in this way has the following requisites: when an article (9) to be packed is resting on the central sector (3), between the first closing wing (49) and the second closing wing (50) (FIGS. 13A, 13B), then:

the first closing wing (49) is foldable towards the central sector (3) so as to wrap at least a first flank of the article (9); the second closing wing (50) is foldable towards the central sector (3) so as to wrap at least a second flank (42) of the article (9) which is opposite the relative first flank (41) (FIGS. 13A, 13B); the first reinforcing wing (51) and the third reinforcing wing (53) are foldable towards the central sector (3) preferably so as to at least partly superpose one another the first reinforcing wing (51), the third reinforcing wing (53) and a first portion (101) of the central sector (3) on which the first reinforcing wing (51) and the third reinforcing wing (52) are superposed to form a first superposing group (17) which is foldable so as to wrap at least a third flank (43) of the article (9) (the third flank (43) of the article (9) is comprised between the relative first flank (41) and second flank (42)); the second reinforcing wing (52) and the fourth reinforcing wing (54) are foldable towards the central sector (3) preferable so as to reciprocally superposed at least partially, the second reinforcing wing (52), the fourth reinforcing wing (54) and a second portion (102) of the central sector (3) on which the second reinforcing wing (52) and the fourth reinforcing wing (52) are superposed to form a second superposing group (18) which is foldable so as to wrap at least a fourth flank (44) of the article (9) which is opposite the relative third flank (43).

The first scoring line (11) and the second scoring line (12) function as corresponding hinge axes with respect to which the first reinforcing wing (51), the first closing wing (49), the second reinforcing wing (52), the third reinforcing wing (53), the second closing wing (50) and the fourth reinforcing wing (54) can rotate.

The first superposing group (17) and the second superposing group (18), on the other hand, do not rotate about any scoring line; this requires selecting a cardboard band (2) having a structure of material suitable for obtaining in any case an easy folding of the first superposing group (17) and the second superposing group (18) respectively against the third flank (43) and the fourth flank (44) of the article (9) resting on the central sector (3). Concerning the structure of the cardboard band (2), it is preferably made up of a first sheet (29) having a planar development and a second sheet (30) having an undulated development; the second sheet (30) is fixed to the first sheet (29), see FIG. 12B. The cardboard band (2) thus obtained advantageously exhibits good characteristics of flexibility and foldability and can be even wound on a reel (19) (FIG. 1); the cardboard band (2) having the above-described structure can be made of a material commonly available on the market.

Also, the cardboard band (2) can preferably be fed with the second sheet (30) orientated upwards; in this way, when the article (9) to be packed is released onto the central sector (3), the article (9) contacts the second sheet (30); as will become clear in the following, this is so that the pack obtained by the folding of the packing carton (1) externally exhibits only the first sheet (29) (FIGS. 17A, 17B), which gives the carton itself a greater degree of rigidity and resistance to impacts or cuts.

The method steps described above are preferably carried out in order from a) to e); however the steps can be carried out in a different order, for example a), c), d), b), e).

The positions of the first crease line (11) and the second crease line (12) are chosen so as preferably to be symmetrical with respect to the axis of the band of carton (2). As a consequence, the first lateral sector (4) is identical to the second lateral sector (5).

Further, preferably, the first cut (21) is aligned with the third cut (23) and the second cut (22) is aligned with the fourth cut (24). Consequently the following occurs: the first reinforcing wing (51) and the third reinforcing wing (53) are identical to one another and symmetrically arranged with respect to the axis of the band of carton (2), the second reinforcing wing (52) and the fourth reinforcing wing (54) are identical to one another and symmetrically arranged with respect to the axis of the band of carton (2); the first closing wing (49) and the second closing wing (50) are identical to one another and symmetrically arranged with respect to the axis of the band of carton (2).

The extensions of the first lateral sector (4) and the second lateral sector (5), measured perpendicularly to the development direction, are each preferably comprised between 50% and 100% (FIG. 13A) of the corresponding extension of the central sector (3); in this way it is ensured that the first reinforcing wing (51) and the third reinforcing wing (53) superpose at least partially on one another. Therefore, the first superposing group (17) and the second superposing group (18) will be advantageously characterised by at least two layers of cardboard (up to a maximum of three layers of cardboard) each for respectively protecting the third flank (43) and the fourth flank (44) of the article (9) to be packed.

From the above it is clear that it is possible to "regulate" the degree of superposing between the first reinforcing wing (51) and the third reinforcing wing (53) and between the second reinforcing wing (52) and the fourth reinforcing wing (54) according to the type of article (9) to be packed (for example a fragile article (9) can be packed with the maximum possible number of layers of cardboard).

Each region of band (8) preferably has a development, measured in a perpendicular direction to the development direction, which is equal to the width of the cardboard band (2).

Preferably, on each region of band (8), the first cut (21), the second cut (22), the third cut (23) and the fourth cut (24) each cause elimination of a corresponding strip of material of the same region of band (8), so that there are identified respectively a first window (31), a second window (32), a third window (33) and a fourth window (34); each of the windows preferably conforms a rectangular opening.

The fact that the cuts made on each region of band (8) define corresponding windows is very advantageous, as will be more fully explained in the following.

A first folding strip (61) is defined on the central sector (3), having a length, measured perpendicularly to the development direction, which is equal to the width of the central sector (3) and a width, measured parallel to the development direction, which is equal to the width of the first window (31) and the third window (33); this first folding strip (61) borders with the first superposing group (17) and equivalently represents a transversal score line for the first superposing group (17), which rotates about the first folding strip (61) (FIG. 14) when it is folded against the third flank (43) of the article (9) resting on the central sector (3). The first superposing group (17) easily rotates about the first folding strip (61) as it is formed by a single layer of cardboard, differently to the first superposing group (17) which has at least two layers of cardboard (a first layer is formed by the central sector (3) and a second layer is formed by the first reinforcing wing (51) or by the third reinforcing wing (53)).

Also, a second folding strip (62) is defined on the central sector (3), having a length, measured perpendicularly to the development direction, which is equal to the width of the central sector (3) and a width, measured parallel to the development direction, which is equal to the width of the second window (32) and the fourth window (34); this second folding strip (62) borders with the second superposing group (18) and equivalently represents a transversal score line for the second superposing group (18), which rotates about the second folding strip (62) (FIG. 14) when it is folded against the fourth flank (44) of the article (9) resting on the central sector (3). The second superposing group (18) easily rotates about the second folding strip (62) as it is formed by a single layer of cardboard, differently to the second superposing group (18) which has at least two layers of cardboard (a first layer is formed by the central sector (3) and a second layer is formed by the second reinforcing wing (51) or by the fourth reinforcing wing (54)).

The packing carton (1) is designed according to the article (9) to be packed with the aim of preferably forming a containing wrapper of the article (9) itself; for this reason, the packing carton (1) has to cover not only the bottom and the flanks of the article (9) but preferably also the upper side of the article (9) by means of at least a layer of carton (1). To obtain the covering of the upper side of the article (9), the packing carton (1) can be dimensioned to so that a first condition and/or a second condition, described in the following, can be satisfied. The first condition is that the first superposing group (17) and the second superposing group (18) are dimensioned to respective wrap the third flank (43) and a first part of the upper side of the article (9) and the fourth flank (44) and a second part of the upper side of the article (9) to the point that the first superposing group (17) and the second superposing group (18) partially superpose on one another at the upper side of the article (9). The first part of the upper side of the article (9) and the second part of the upper side of the article (9) partially superpose on one another and together entirely involve the upper side of the article (9). The second condition is that the first closing wing (49) and the second closing wing (50) are dimensioned so as to respective wrap the first flank (41) and a third part of the upper side of the article (9) and the second flank (42) and a fourth part of the upper side of the article (9) to the point that the first closing wing (49) and the second closing wing (50) superpose partially on one another at the upper side of the article (9). The third part of the upper side of the article (9) and the fourth part of the upper side of the article (9) partially superpose on one another and together entirely involve the upper side of the article.

The packing carton (1) illustrated in the figures (FIGS. 13, 14) clearly shows that both the first and the second condition have been satisfied: thus, the upper side of the article (9) is entirely covered at every point thereof with at least two layers of cardboard.

Figure 14:
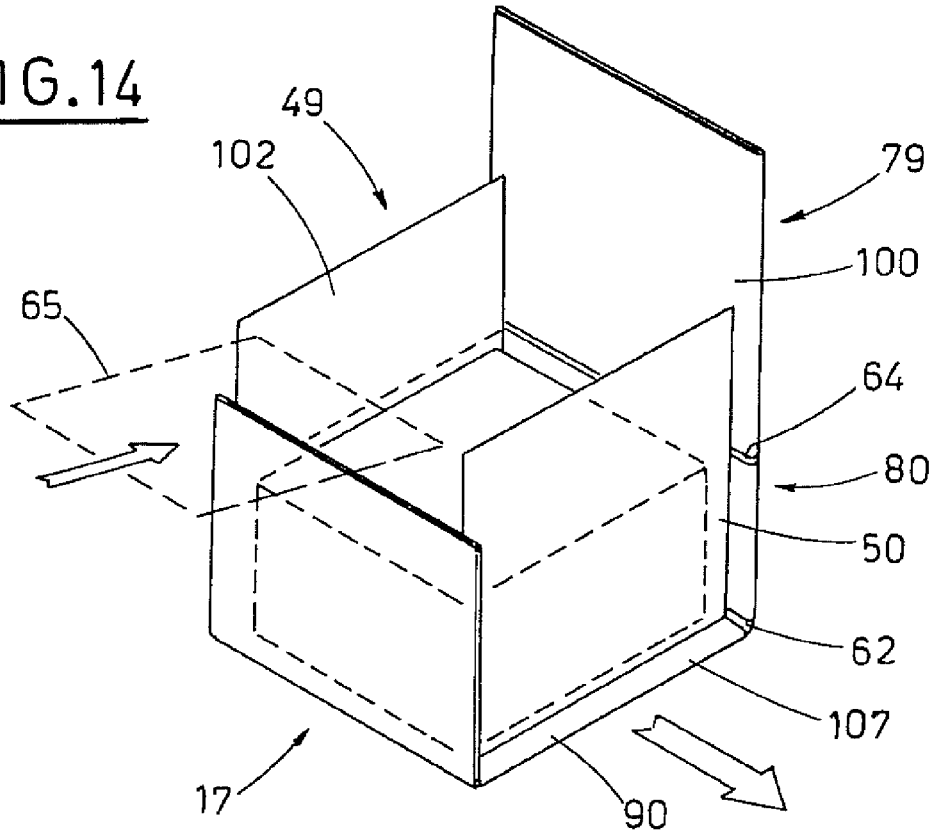
FIG. 14 is a perspective view illustrating release of a document to rest on the upper side of the first article after a second folding step of the first packing carton has been completed.

FIG. 14 illustrates a step in which a document (65) (for example an invoice) is inserted resting on an upper side of the article (9), before the packing is completed.

Figure 15:
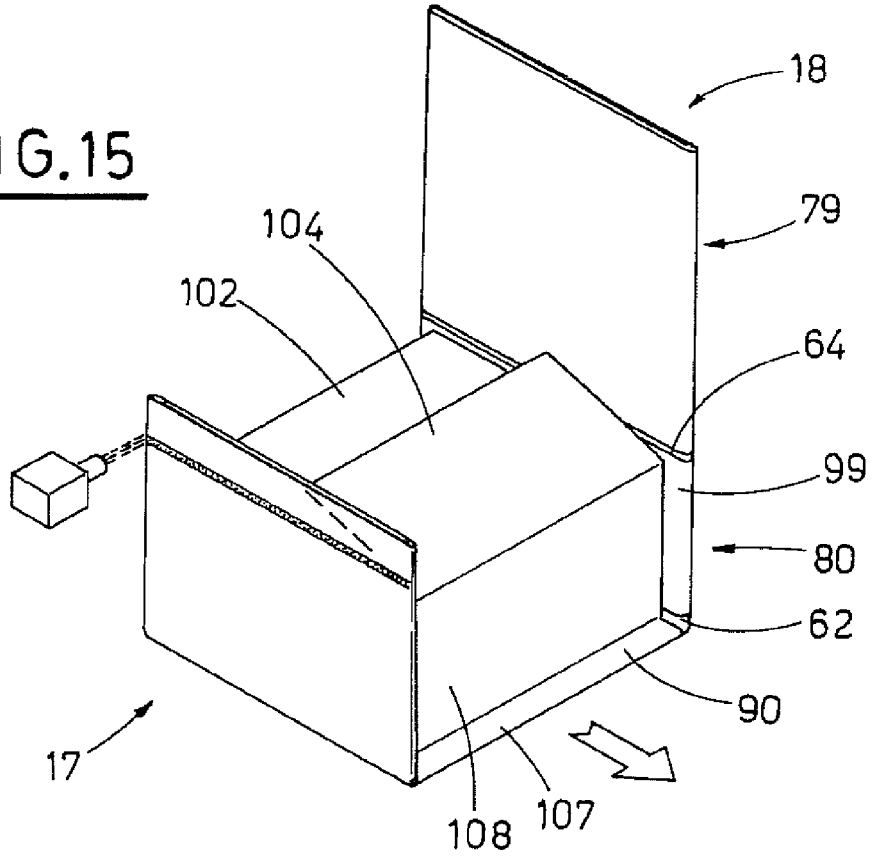
FIG. 15 is a perspective view illustrating application of glue on a portion of the first packing carton after a third folding step of the first packing carton has been completed.

The following sealing of the packing carton (1) with the aim of forming a wrapping containing the article (9) can be realized in a substantially known way by applying a layer of glue on an appropriate portion of the packing carton (1), as illustrated in FIG. 15.

Figure 16:
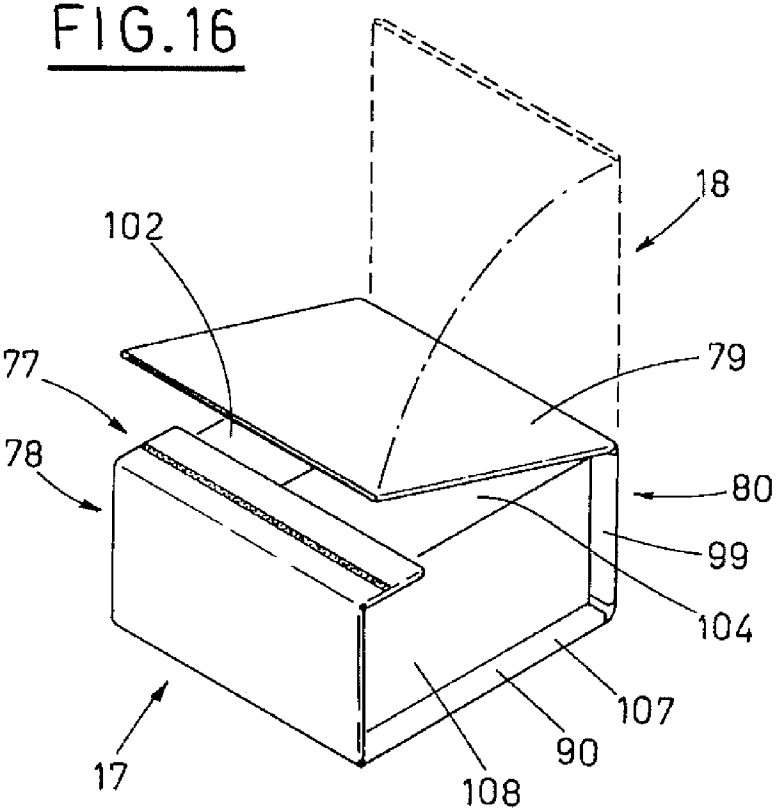
FIG. 16 is a perspective view illustrating a fourth folding step of the first packing carton for obtaining a seal pack containing the first article.

FIG. 16 shows the folding of the second superposing group (18) against the first superposing group (17) so as to realise the sealing and closing of the wrapping.

Figure 17A:
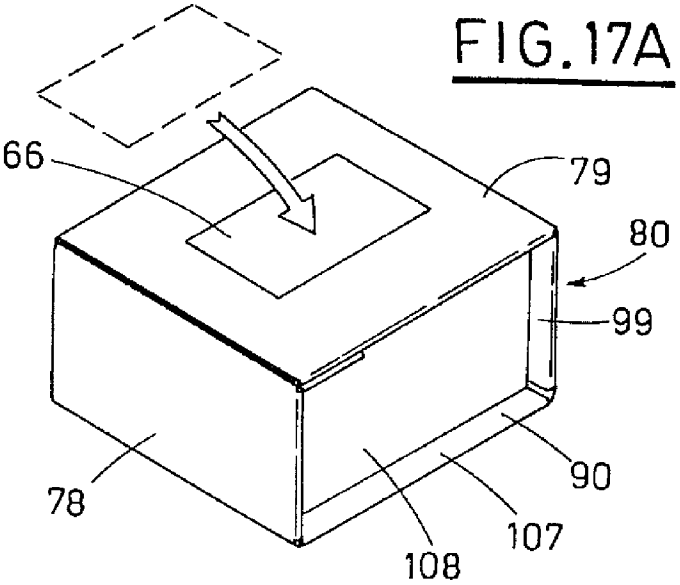
FIG. 17A is a perspective view illustrating the carton after the fourth folding step has been completed, and which illustrates application of a label.
Figure 17B:
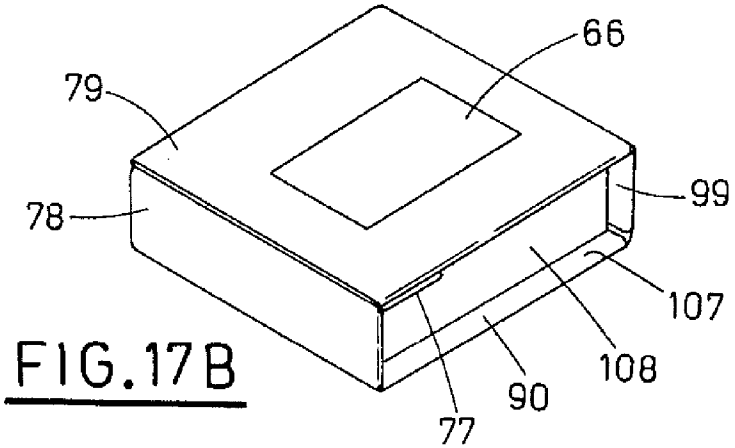
FIG. 17B is a view alike to that of FIG. 17A from which it differs for the fact that the pack contains the second article of FIG. 13B and has been obtained using the second packing carton of FIG. 13B.

FIG. 17A illustrates the step of applying a label (66) to the wrapping.

In its essential aspects, the apparatus (10) for realising cartons (1) for packing, which actuates the above-described method, comprises:

supply means for feeding a cardboard band (2);

scoring means for making a first score line (11) and a second score line (12) on the cardboard band (2);

identifying means for identifying band regions (8) on the cardboard band (2);

first cutting means for realising, on each band region (8), at least a first cut (21), a second cut (22), a third cut (23) and a fourth cut (24);

second cutting means for cutting the cardboard band (2) transversally and separating the band regions (8) from one another, thus obtaining cartons (1) for packing.

The supply means can comprise an electric motor (not illustrated) which activates the reel (19) from which the band of carton (2) unwinds.

The scoring means preferably comprise: a first shaft (70) arranged above the advancing cardboard band (2); a first scoring wheel (71) borne by the first shaft (70), which first scoring wheel (71) is rotatable with respect to an axis thereof such as to realise the first scoring wheel (11); a second scoring wheel (72) borne by the first shaft (70), which second scoring wheel (72) is rotatable with respect to an axis thereof such as to realise the second score line (12).

The first shaft (70) can be constrained to the frame (67) of the apparatus (10).

The scoring means can further comprise: a first support (81) which is constrained to the first shaft (70) and which in turn bears the first scoring wheel (71); a second support (82) which is constrained to the first shaft (70) and which in turn bears the second scoring wheel (72).

The first scoring wheel (71) and the second scoring wheel (72) are preferably drawn in rotation by actuators (not illustrated).

The scoring means preferably occupy a fixed position of a tract of supply of the cardboard band (2) (FIGS. 1, 2). This means that the first shaft (70) does not translate along the development direction of the cardboard band (2); thus, the first scoring wheel (71) and the second scoring wheel (72) perform the first score line (11) and the second score line (12) thanks to the advancing of the underlying cardboard band (2).

The means for identifying the regions of band (8) on the cardboard band (2) can be the control unit of the apparatus (10), not illustrated. The control unit can establish the dimensions of each region of band (8) on the basis of the dimensions of the article (9) to be packed; further, the control unit can regulate the activating of the reel (19) and therefore at any moment can return to each region of band (8).

The first cutting means are arranged preferably downstream of the scoring means (FIGS. 1, 2).

The first cutting means preferably comprise: a first scissors (91) and a second scissors (92) which act on the first lateral end (6) of the cardboard band so as to carry out, on each region of band (8), respectively the first cut (21) and the second cut (22); a third scissors (93) and a fourth scissors (94) which act on the second lateral end (7) of the cardboard band (2) so as to carry out respectively the third cut (23) and the fourth cut (24) on each region of band (8).

The first scissors (91), the second scissors (92), the third scissors (93) and the fourth scissors (94) are preferably contemporaneously activated so as to act on the cardboard band (2); preferably, the cardboard band (2) is halted for the necessary time for the first scissors (91), second scissors (92), third scissors (93) and fourth scissors (94) to carry out respectively the first cut (21), the second cut (22), the third cut (23) and the fourth cut (24). After each scissors has disengaged the cardboard band (2), the band (2) is newly activated to advance.

The first scissors (91), the second scissors (92), the third scissors (93) and the fourth scissors (94) are preferably: identical to one another and each conformed to remove a corresponding strip of material from each region of band (8) of the cardboard band (2), leaving the above-defined windows identified with reference to the method. Therefore, each first cut (21) produced by the first scissors (91) defines the first window (31) of a corresponding region of band (8), each second cut (22) produced by the second scissors (92) defines the second window (32) of a corresponding region of band (8), each third cut (23) produced by the third scissors (93) defines the third window (33) of a corresponding region of band (8) and each fourth cut (24) produced by the fourth scissors (94) defines the fourth window (34) of a corresponding region of band (8).

Figure 8:
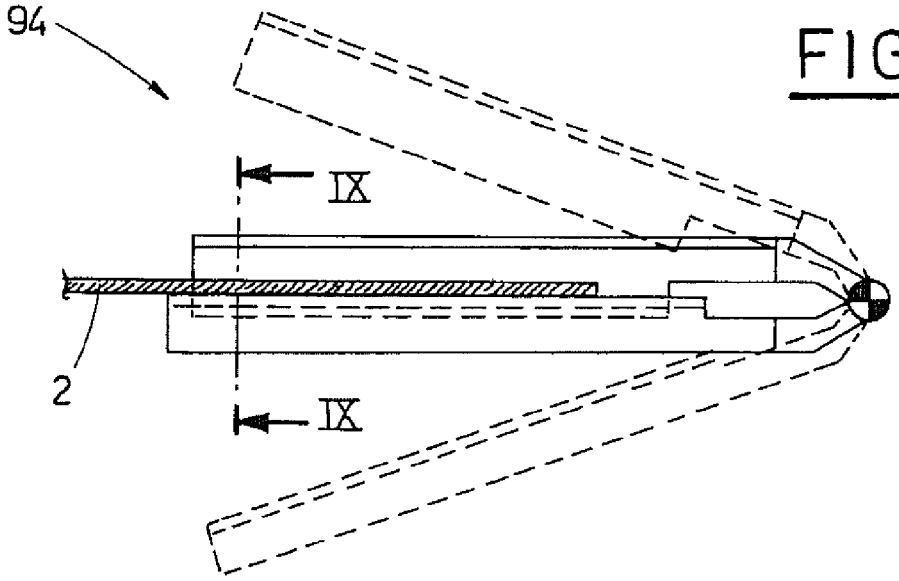
FIG. 8 is a larger-scale view of the section VIII-VIII of FIG. 7A showing two distinct positions assumed by a scissors of the cutting unit, one shown in a continuous line and the other shown in a broken line.
Figure 9A:
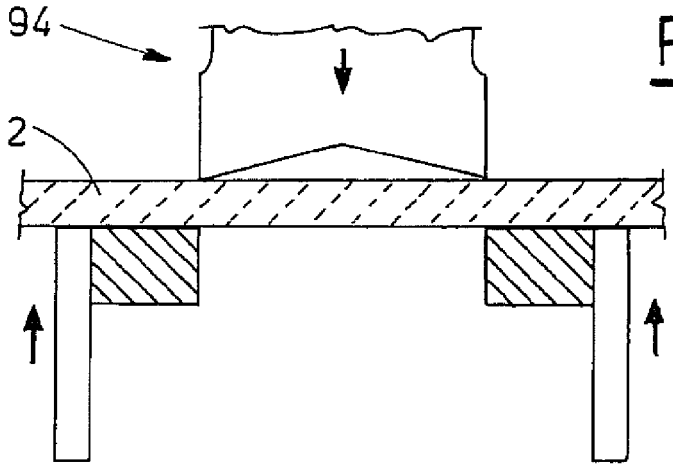
FIGS. 9A, 9B are views of section IX-IX of FIG. 8 showing the above-mentioned positions assumed by the scissors.
Figure 9B:
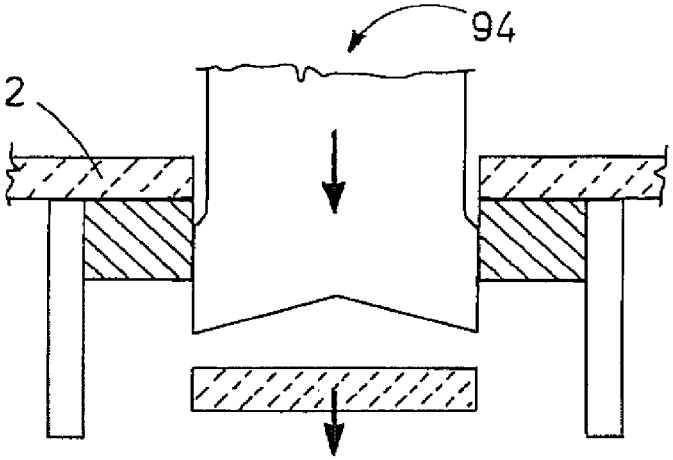

FIGS. 8, 9A, 9B illustrate a possible conformation and functioning of one of the above-cited scissors, in this case the fourth scissors (94): the fourth scissors (94) have an upper blade and a lower counter-blade which are hinged to one another. The profile of the cutting edge of the upper blade preferably has a U-shape so as to remove, as mentioned, a strip of material from the cardboard band (2) and leave the fourth window (34) identified in a region of band (8).

The second cutting means (39) are preferably arranged downstream of the first cutting means and, as mentioned, act to carry out a transversal cut on the cardboard band (2) with the aim of separating the regions of band (8) from one another and obtain corresponding packing cartons (1).

Figure 18:
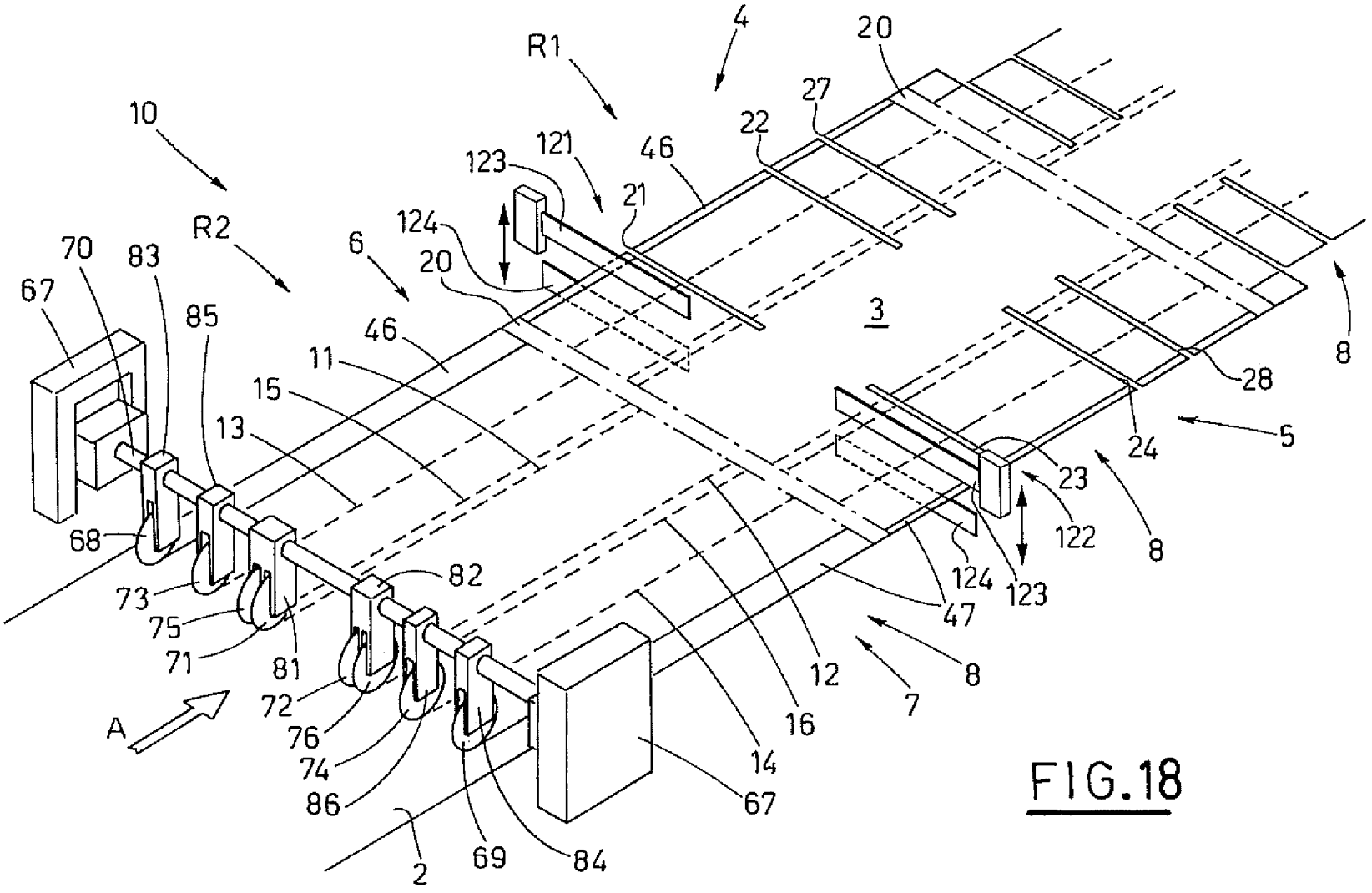
FIG. 18 is a view alike to that of FIG. 2 but illustrating a variant of the first cutting means of the apparatus of FIG. 1.

With reference to FIG. 18, there follows a description of a variant of the apparatus. The feeding means of the cardboard band (2) are step-feeding means. Further, the first cutting means comprise: a first guillotine (121) acting vertically on the first lateral sector (4) of each region of band (8) so as to carry out a plurality of cuts (21, 22, 25, 27) in synchrony with the step-advancing of the cardboard band (2); a second guillotine (122) acting vertically on the second lateral sector (5) of each region of band (8) so as to carry out a plurality of cuts (23, 24, 25, 26) in synchrony with the step-advancing of the cardboard band (2).

In detail, the first guillotine (121) carries out the first cut (21) and the second cut (22), while the second guillotine (122) carries out the third cut (23) and the fourth cut (24).

The first guillotine (121) and the second guillotine (122) are preferably aligned to one another and act vertically on each region of band (8) of the cardboard band (2) when the band is stationary, so as to realize the second cut (22) and the fourth cut (24) and successively to realize the first cut (21) and the third cut (23).

The first guillotine (121) and the second guillotine (122) preferably act contemporaneously.

The first guillotine (121) and the second guillotine (122) are preferably identical to one another and each conformed to remove a corresponding strip of material from each region of band (8) of the cardboard band (2), leaving the above-described windows identified with reference to the method. Therefore, each first cut (21) produced by the first guillotine (121) defines the first window (31) of a corresponding region of band (8), each second cut (22) produced by the first guillotine (121) defines the second window (32) of a corresponding region of band (8), each third cut (23) produced by the second guillotine (122) defines the third window (33) of a corresponding region of band (8) and each fourth cut (24) produced by the second guillotine (122) defines the fourth window (34) of a corresponding region of band (8). See FIG. 12A.

The first guillotine (121) and the second guillotine (122) can each comprise an upper blade (123) which is vertically mobile and a lower blade (124) that is fixed. The profile of the cutting edge of the upper blade (123) of the first guillotine (121) preferably exhibits a U-shape so as to remove, as mentioned, a strip of material from the band (2) of cardboard and leave the third window (33) or the fourth window (34) identified in a region of band (8). The profile of the cutting edge of the upper blade (123) of the second guillotine (122) si preferably U-shaped so as to remove a strip of material from the cardboard band (2) and leave the third window (33) or the fourth window (34) identified in a region of band (8).

The method preferably further comprises steps of selectively adjusting, according to the dimensions of the article (9) to be packed:

the position of the first score line (11); and/or the position of the second score line (12); and/or the extensions of each band region (8), measured in a parallel direction to the extension direction, and consequently the positions in which to transversally cut the cardboard band (2) to separate the band regions (8) to one another; and/or the position of the first cut (21), the second cut (22), the third cut (23) and the fourth cut (24) internally of each band region (8).

These adjustments further enable advantageously establishing the number of layers of cardboard that will wrap the third flank (43), the fourth flank (44) and the upper side of the article (9) to be packed.

To regulate the positions of the first score line (11) and/or the second score line (12) it is preferable: that the first shaft (70), which as has been specified is constrained to the frame (67) of the apparatus (10), is in particular mobile nearingly and distancingly with respect to the advancing cardboard band (2); and that the positions of the first scoring wheel (71) and the second scoring line (72) are adjustable along the first shaft (70).

Therefore the first shaft (70) can be constrained to the frame (67) with a degree of freedom which enables it to near and distance to and from the advancing cardboard band (2) in a vertical direction. In the example illustrated in the figures (see FIG. 2) the ends of the first shaft (70) engage in vertical guides fashioned in corresponding elements of the frame (67) of the apparatus (10).

The first support (81) and the second support (82) can therefore be carriages able to slide along the first shaft (70) (which functions as a sliding guide) so that the first scoring wheel (71) and the second scoring wheel (72) can easily translate along the first shaft (70), enabling adjustment of the positions of the first score line (11) and the second score line (12) according to the dimensions of the article (9) to be packed.

It is specified above that the band can be stopped temporarily so as to perform the first cut (21), the second cut (22), the third cut (23) and the fourth cut (24).

In a case in which it is necessary to vary the positions of the first score line (11) and the second score line (12) during the transition from a first region of band (R1) and a successive second region of band (R2), it is possible to translate the first shaft (70), the first scoring wheel (71) and the second scoring wheel (72) when the band is stationary. Thus between the first region of band (R1) and the second region of band (R2) a waste strip (20) will be defined, having a length, measured perpendicularly to the development direction, equal to the width of the cardboard band (2); the discontinuity of the first score line (11) and the second score line (12) can clearly be recognized in this strip of waste (20). If the regulating of the first shaft (70), the first scoring wheel (71) and the second scoring wheel (72) are done when the band is stationary, the width of the strip of waste (20), measured parallel to the development direction, will be minimal; alternatively, if these adjustments are done during the movement of the cardboard band (2), the width will be greater and will depend on the advancement velocity of the band.

Figures 10A, 10B, 11:
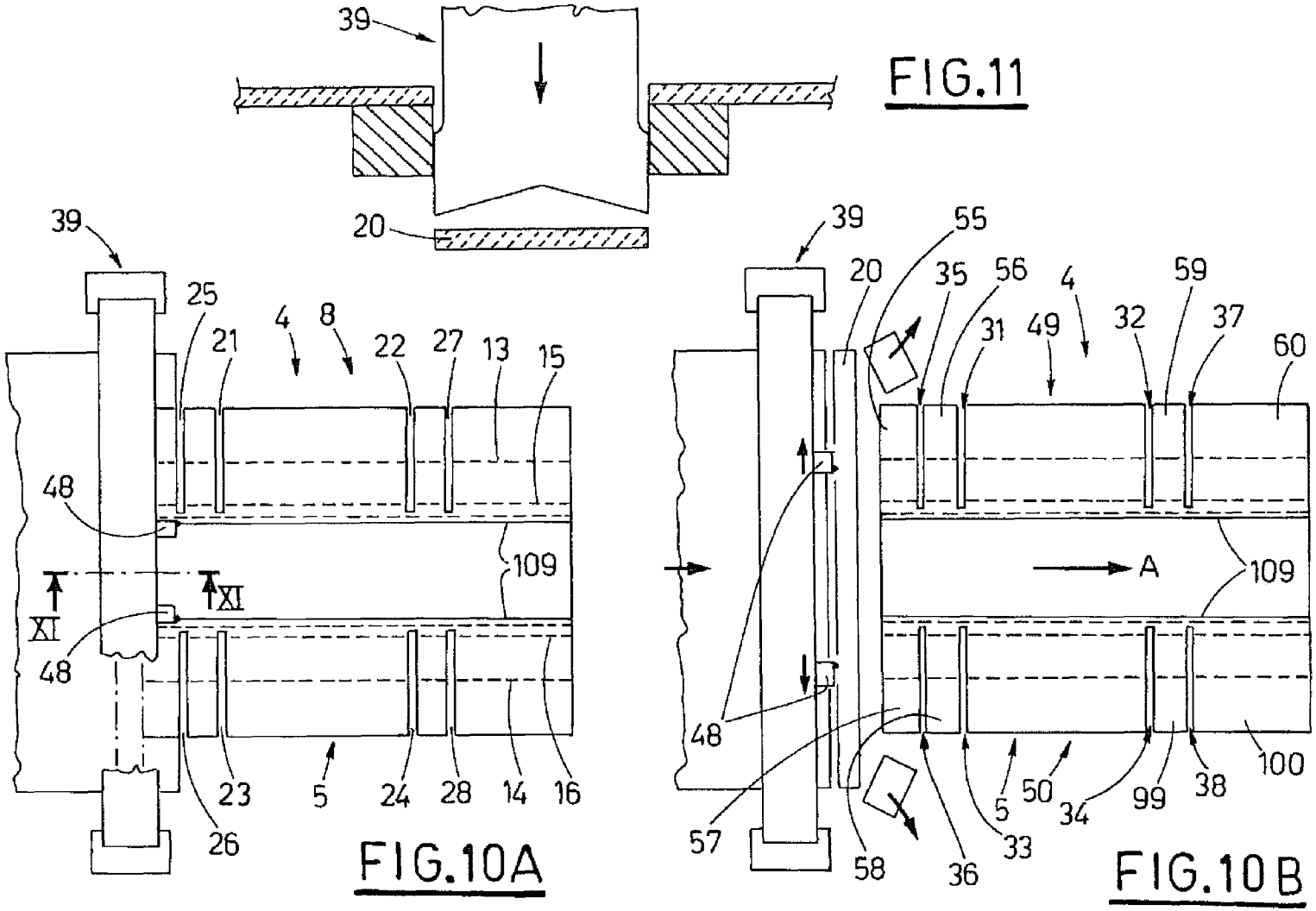
FIGS. 10A, 10B are views from above of second cutting means which are a part of the apparatus of FIG. 1, denoted with reference J2 in FIG. 1, which figures show two significant successive instants.
FIG. 11 is a larger-scale view of section XI-XI of FIG. 10A.

To limit the dimensions of the strip of waste (20) to be eliminated, it is preferable for the adjustments of the first shaft (70), the first scoring wheel (71) and the second scoring wheel (72) to take place when the cardboard band (2) is stationary. The fact that the strip of waste (20) has a minimal width has a further advantage: in fact it is possible to eliminate the strip of waste (20) using the second cutting means (39) (which will also perform the separating between the first region of band (R1) and the second region of band (R2)) with a single cutting operation if the cutting edge of the blade of the second cutting means (39) is U-shaped (FIG. 11) and as suitable dimensions for eliminating a strip of cardboard band (2) having an area at least equal to the area of the strip of waste (20) (FIGS. 10A, 10B). The extension of each region of band (8) parallel to the development direction can instead be established by regulating the intervention time of the second cutting means (39) in order to cut the cardboard band (2) transversally; for example, by lengthening the intervention time regions of band (8) will be obtained having a greater extension.

To vary the position of the first cut (21), the second cut (22), the third cut (23) and the fourth cut (24) along the direction of development the first scissors (91), the second scissors (92), the third scissors (93) and the fourth scissors (94) can be made mobile along the development direction; further, to vary the depth (and therefore the extension) of these cuts (note that the cuts must preferably reach the first score line (11) and the second score line (12), which are in turn adjustable and therefore mobile) the scissors can be made mobile also in a perpendicular direction to the development direction.

The regulating of the positions of the scissors can occur during the advancement of the cardboard band (2), i.e. when they do not have to perform a cut; in this case, when the cardboard band (2) is stopped the scissors will only have to perform the cuts.

Figure 7A:
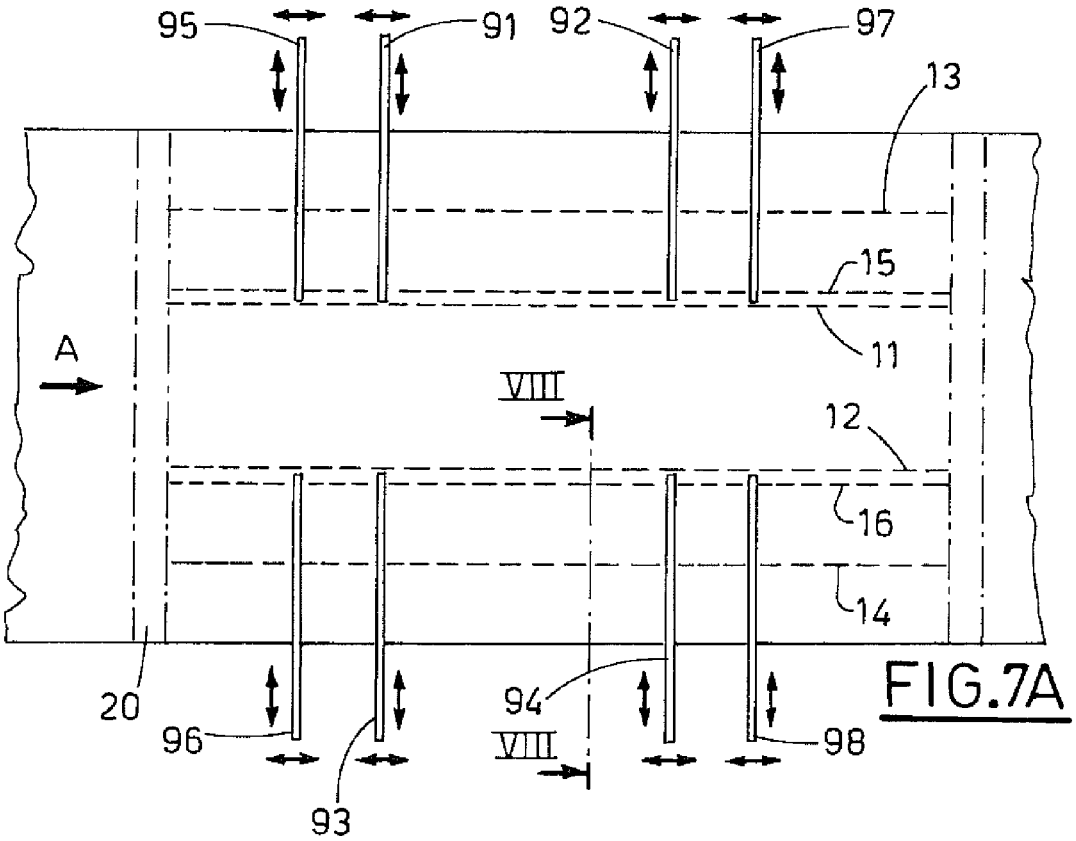
FIGS. 7A, 7B are views from above of first cutting means illustrated in FIG. 2, during two successive time instants with the aim of showing a regulating step of the relative scissors.
Figure 7B:
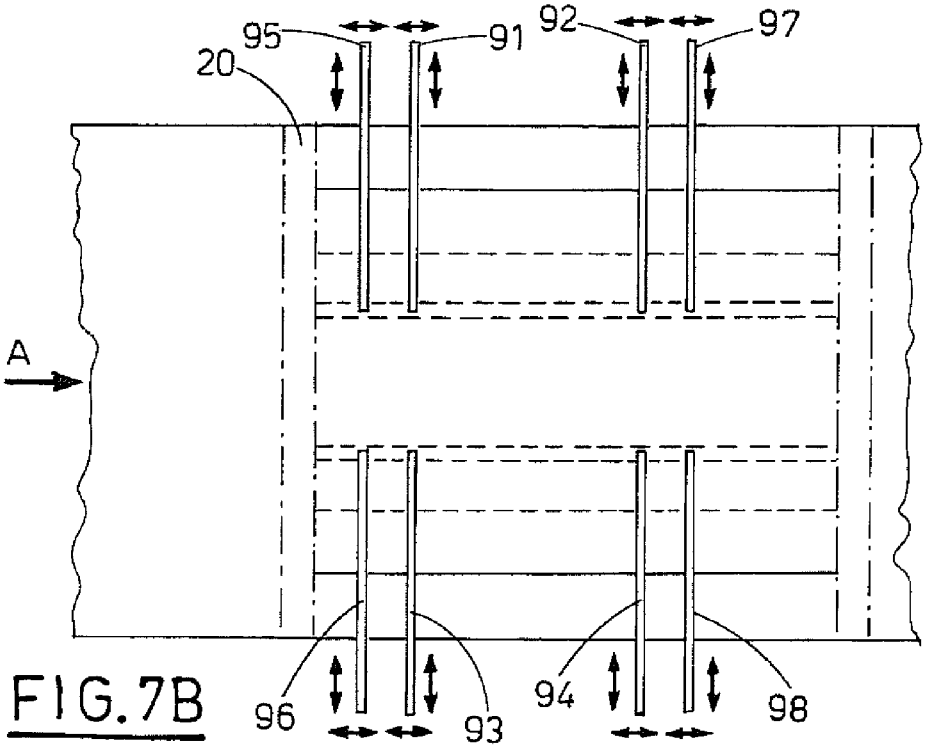

FIGS. 7A, 7B show the movement of the first scissors (91), the second scissors (92), the third scissors (93) and the fourth scissors (94) in parallel and perpendicular directions to the development direction in the hypothesis in which the cuts to be performed on the second region of band (R2) have to be in different positions from the cuts already made on the first region of band (R1).

With reference to the variant of the apparatus, illustrated in FIG. 18, to vary the position of the first cut (21), the second cut (22), the third cut (23) and the fourth cut (24) along the development direction it is sufficient to modify the stop position of the cardboard band (2), this is particularly advantageous as it does not require making the first guillotine (121) and the second guillotine (122) mobile in a parallel direction to the development direction.

To vary the depth (and therefore the extension) of these cuts the first guillotine (121) and the second guillotine (122) can be mobile in a perpendicular direction to the development direction.

The articles (9) to be packed can have known dimensions (width, length, height) or can be identified by a reading of a label (66) or code placed on the article (9) itself; if the precise dimensions of the article (9) to be packed are not known, it is possible to use, for example, systems for acquiring the dimensions of the articles (9), which comprise television cameras (40).

FIG. 1 illustrates: a first conveyor (45) on which the articles (9) are arranged; and tv cameras (40) arranged above the first conveyor (45), which acquire images of the article (9) so as to enable a suitable software program to obtain the dimensions of the article (9).

Once the dimensions of the article (9) are known, it is possible to shape a region of band (8), and therefore a packing carton (1), having suitable characteristics for packing the article (9).

The possibility of modifying, for each region of band (8), the characteristics (positions of the first score line (11), the second score line (12), cuts) and dimensions (length measure parallel to the development direction) enables packing articles (9) also having considerably differing dimensions.

There exist however limits for the minimum and maximum dimensions of the articles (9) which can be packed and the limits depend on the width of the cardboard band (2).

Figure 13A:
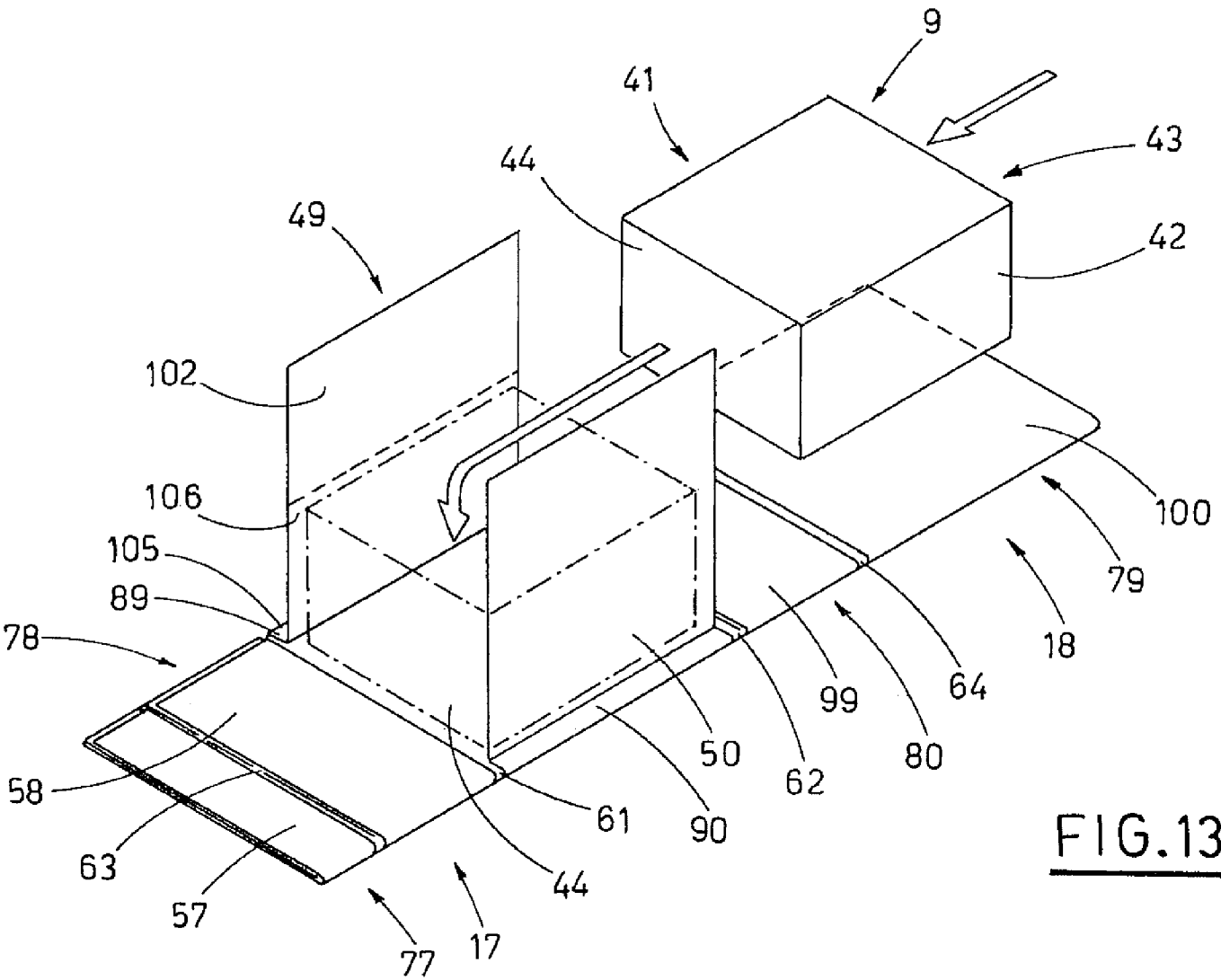
FIG. 13A is a perspective view illustrating the release of a first article resting on the first packing carton after the first folding step has been completed.
Figure 13B:
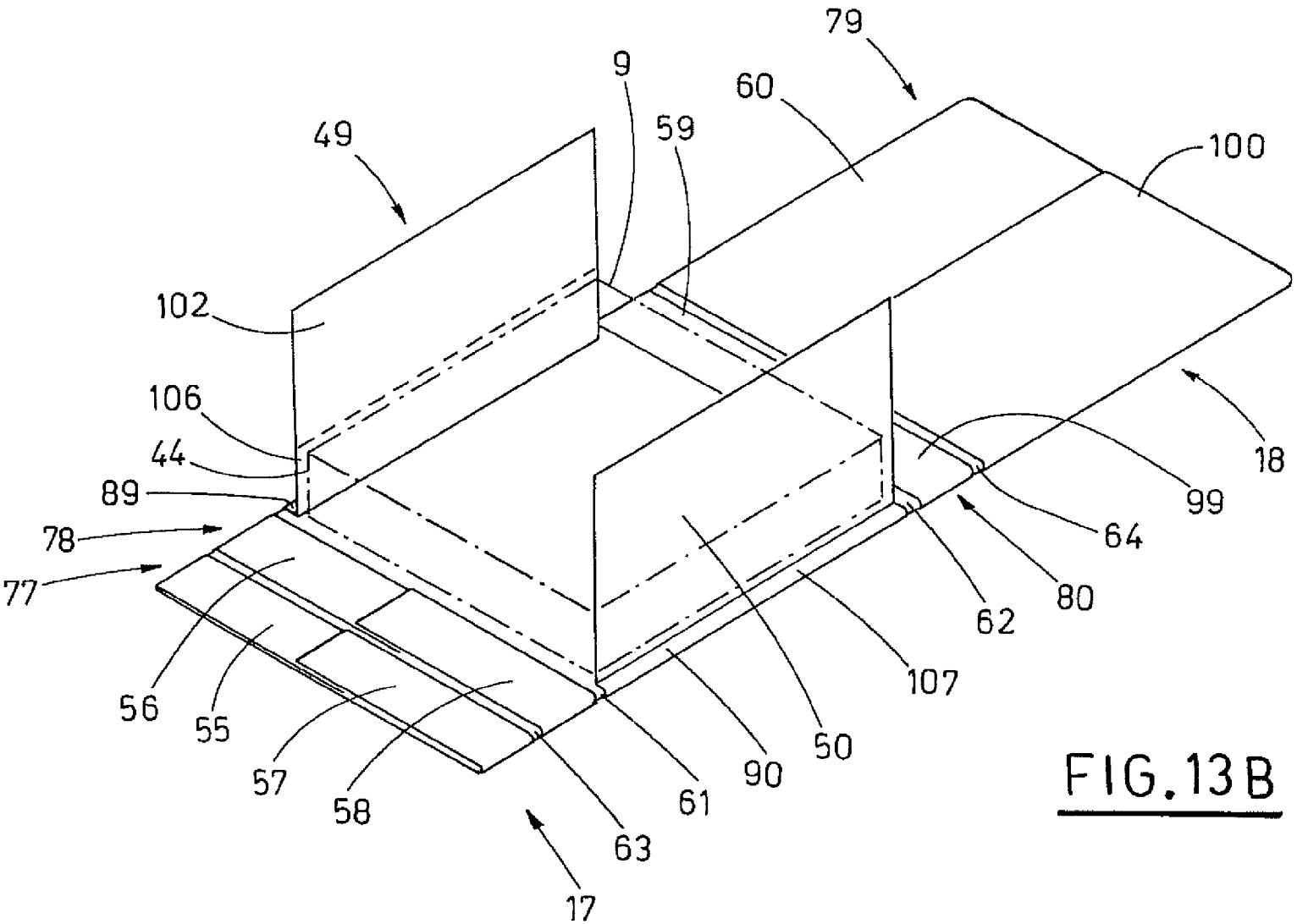
FIG. 13B is a perspective view illustrating release of a second article to rest on a second packing carton, also obtained with the apparatus of the invention, after the first folding step has been completed.

For example, FIG. 13A illustrates a first article (9) having a width, measured perpendicular to the development direction, which is the minimum allowed: in fact, the first reinforcing wing 851) and the third reinforcing wing (53) superpose completely on one another and on the first portion (101) of the central sector (3), while the second reinforcing wing (52) and the fourth reinforcing wing (54) superpose completely on one another and on the second portion (102) of the central sector (3). This means that the extensions of the first lateral sector (4) and the second lateral sector (5), measured perpendicularly to the development direction, each correspond by 100% to the extension of the central sector (3).

The method preferably comprises a step or steps of cutting an edge strip of the cardboard band (2) which is located at the first lateral end (6) of the cardboard band (2) and/or at the second lateral end (7) of the cardboard band (2) as a function of the dimensions of the article (9) to be packed.

Therefore, for each region of band (8) it is possible to cut, if necessary: an edge strip located at the first lateral end (6) of the cardboard band (2) or at the second lateral end (7) of the cardboard band (2); or a first edge strip (46) located at the first lateral end (6) of the cardboard band (2) and a second edge strip (47) located at the second lateral end (7) of the cardboard band (2), preferably identical to one another so as to be symmetrical with respect to the axis of the cardboard band (2) (FIG. 2).

In other words it is possible to dynamically vary the width of the cardboard band (2) according to the dimensions of the article (9) to be packed; this is very advantageous in that it enables packing a still greater variety of articles (9) having different dimensions to one another.

In order to cut and therefore eliminate the edge strip, the apparatus (10) preferably comprises a cutting wheel; the cutting wheel is preferably borne by the first shaft (70), is rotatable with respect to the axis thereof and conforms a circular cutting edge. The apparatus (10) can comprise a support for the cutting wheel which can slide along the first shaft (70) and which bears the cutting wheel, so that it is possible to adjust the width, measured perpendicularly to the development direction, of the edge strip to be cut.

The position of the cutting wheel along the first shaft (70) can be regulated preferably when the cardboard band stops for the cutting operations; in this case the first shaft (70) distances from the cardboard band (2) (i.e. raises) and the support for the cutting wheel can slide to bring the cutting wheel into a new position.

The figures illustrate a first cutting wheel (68) and a second cutting wheel (69) for respectively cutting the first edge strip (46) and the second edge strip (47); the first cutting wheel (68) is brought to a third support (83), which can slide along the first shaft (70), while the second cutting wheel (69) is borne by a fourth support (84), which can slide along the first shaft (70).

The first edge strip (46) is therefore cut longitudinally by the first cutting wheel (68) in a parallel direction to the development direction, while it is cut transversally by the second cutting means (39) which detach it definitively from the cardboard band (2). Likewise, the second edge strip (47) is cut longitudinally by the second cutting wheel (69) in a parallel direction to the development direction, while it is cut transversally by the second cutting means (39) which detach it definitively from the cardboard band (2).

The method preferably comprises that on each band region (8) the following are further carried out: a fifth cut (25) made in a transversal direction to the extension direction of the cardboard band (2) such as to divide the first reinforcing wing (51) into two parts, i.e. a fifth reinforcing wing (55) and a sixth reinforcing wing (56); a sixth cut (26) made in a transversal direction to the extension direction of the cardboard band (2) such as to divide the third reinforcing wing (53) into two parts, i.e. a seventh reinforcing wing (57) and an eighth reinforcing wing (58); the fifth reinforcing wing (55) being opposite the seventh reinforcing wing (57) and the sixth reinforcing wing (56) being opposite the eighth reinforcing wing (58); the positions of the fifth cut (25) and the sixth cut (26) being selected such that the extensions of the sixth reinforcing wing (56) and the eighth reinforcing wing (58), measured along the extension direction, are in relation to the height of a third flank (43) of an article (9) to be packed which is resting on the central sector (3), between the first closing wing (49) and the second closing wing (50), the third flank (43) being exposed towards the tract of central sector (3) to which are hinged, by the first score line (11) and the second score line (50), the fifth reinforcing wing (55), the sixth reinforcing wing (56), the seventh reinforcing wing (57) and the eighth reinforcing wing (58).

The fifth cut (25) is preferably aligned with the sixth cut (26).

The extensions of the sixth reinforcing wing (56) and the eighth reinforcing wing (58), measured along the development direction, are greater than or equal to (preferably equal to) the height of the third flank (43) of the article (9) to be packed.

The first superposing group (17) therefore comprises: a first group (77) formed by the fifth reinforcing wing (55) and the seventh reinforcing wing (57) superposed on one another and by the portion of central sector (3) to which the fifth reinforcing wing (55) and the seventh reinforcing wing (57) are superposed; and a second group (78) formed by the sixth reinforcing wing (56) and the eighth reinforcing wing (58) superposed on one another and by the portion of central sector (3) to which the sixth reinforcing wing (56) and the eighth reinforcing wing (58) are superposed.

The fifth cut (25) and the sixth cut (26) facilitate the folding of the first superposing group (17) so as to wrap the third flank (43) and the first part of the upper side of the article (9) resting on the central sector (3); in particular, the second group (78) is arranged at an angle, preferably by 90°, with respect to the portion of central sector (3) on which the article (9) rests and the first group (77) is arranged at an angle, preferably by 90°, with respect to the second group (78) so as to cover the first part of the upper side of the article (9).

On each region of band (8), the fifth cut (25) and the sixth cut (26) preferably cause elimination of a corresponding strip of material of the same region of band (8), so that a fifth window (35) and a sixth window (36) are identified; both the fifth window (35) and the sixth window (36) form a corresponding rectangular opening.

As a consequence, on the central sector (3) between the first group (77) and the second group (78) a third folding strip (63) is defined having a length, measured perpendicularly to the development direction, which is equal to the width of the central sector (3) and a width, measured parallel to the development direction, which is equal to the width, of the fifth window (35) and the sixth window (36); the third folding strip (63) is interposed between the first group (77) and the second group (78) and represents equivalently a transversal score line for the first group (77), which rotates with respect to the second group (78) (FIGS. 15, 16) when the first superposing group (17) is folded against the third flank (43) and the first part of the upper side of the article (9). The first group (77) rotates easily with respect to the second group (78) as the third folding strip (63) separating the first group (77) from the second group (78) is formed by a single layer of cardboard, differently to the first group (77) and the second group (78) which each have at least two layers of cardboard.

To form the fifth cut (25) (which can have the shape of the fifth window (35)), the first cutting means preferably comprise a fifth scissors (95) which acts on the side of the first lateral end (6) of the cardboard band (2) and which is flanked to the first scissors (91); preferably, so as to form the sixth cut (26) (which can have the shape of the sixth window (36)), the first cutting means comprise a sixth scissors (96) which acts on the side of the second lateral end (7) of the cardboard band (2) and which is flanked to the third scissors (93).

The fifth scissors (95) and the sixth scissors (96) can have the same characteristics and functionality as the first scissors (91), the second scissors (92), the third scissors (93) and the fourth scissors (94) already discussed in the foregoing.

In a variant of the apparatus, illustrated in FIG. 18, to form the fifth cut (25) (which can have the shape of the fifth window (35)) and the sixth cut (26) (which can have the shape of the sixth window (36)), is it possible to use respectively the first guillotine (121) and the second guillotine (122).

The method preferably comprises that on each band region (8) a seventh cut (27) is made transversally to the extension direction of the cardboard band (2) such as to divide the second reinforcing wing (52) into two parts, i.e. a ninth reinforcing wing (59) and a tenth reinforcing wing (60); an eighth cut (28) made in a transversal direction to the extension direction of the cardboard band (2) such as to divide the fourth reinforcing wing (54) into two parts, i.e. an eleventh reinforcing wing (99) and a twelfth reinforcing wing (100); the ninth reinforcing wing (59) being opposite the eleventh reinforcing wing (99) and the tenth reinforcing wing (60) being opposite the twelfth reinforcing wing (100); the positions of the seventh cut (27) and the eighth cut (28) being selected such that the extensions of the ninth reinforcing wing (59) and the eleventh reinforcing wing (99), measured along the development direction, are in relation with the height of a fourth flank (44) of an article (9) to be packed which is resting on the central sector (3), between the first closing wing (49) and the second closing wing (50), the fourth flank (44) being exposed towards the tract of central sector (3) (previously referred-to as the second portion (102) of the central sector (3)) to which are hinged, by the first score line (11) and the second score line (12), the ninth reinforcing wing (59), the tenth reinforcing wing (60), the eleventh reinforcing wing (99) and the twelfth reinforcing wing (100).

The seventh cut (27) is preferably aligned with the eighth cut (28).

The extensions of the ninth reinforcing wing (59) and the eleventh reinforcing wing (99), measured along the development direction, are preferably greater than or equal to (preferably equal to) the height of the fourth flank (44) of the article (9) to be packed.

The second superposing group (18) therefore comprises: a third group (79) formed by the tenth reinforcing wing (60) and the twelfth reinforcing wing (60) and the twelfth reinforcing wing (100) superposed on one another and by the portion of the central sector (3) on which the tenth reinforcing wing (60) and the twelfth reinforcing wing (100) superpose; and a fourth group (80) formed by the ninth reinforcing wing (59) and the eleventh reinforcing wing (99) superposed on one another and by the portion of central sector (3) on which the ninth reinforcing wing (59) and the eleventh reinforcing wing (99) superpose.

The seventh cut (27) and the eighth cut (28) facilitate the folding of the second superposing group (18) so as to wrap the fourth flank (44) and the second part of the upper side of the article (9) resting on the central sector (3); in particular, the fourth group (80) is arranged at an angle, preferably 90°, with respect to the portion of central sector (3) on which the article (9) is resting, and the third group (7) is arranged at an angle, preferably 90°, with respect to the fourth group (80) so as to cover the second part of the upper side of the article (9).

The seventh cut (27) and the eighth cut (28) preferably cause, on each region of band (8), an elimination of a corresponding strip of material of the same region of band (8), so that respectively a seventh window (37) and an eighth window (38) are identified; both the seventh window (37) and the eighth window (38) form a corresponding rectangular opening.

Consequently, a fourth folding strip (64) is defined on the central sector (3), between the third group (79) and the fourth group (80), having a length, measured perpendicularly to the development direction, which is equal to the width of the central sector (3) and a width, measured parallel to the development direction, which is equal to the width of the seventh window (37) and the eighth window (38); this fourth folding strip (64) is interposed between the third group (79) and the fourth group (80) and represents equivalently a transversal score line for the third group (79), which rotates with respect to the fourth group (80) (FIGS. 15, 16) when the second superposing group (18) is folded against the fourth flank (44) and the second part of the upper side of the article (9). The third group (79) rotates easily with respect to the fourth group (80) as the fourth fold strip (64) separating the third group (79) from the fourth group (80) is formed by a single layer of cardboard, differently to the third group (79) and the fourth group (10) which instead each have at least two layers of cardboard.

To form the seventh cut (27) (which can have the same shape as the seventh window (37)), the first cutting means comprise a seventh scissors (97) acting on the first lateral end (6) of the cardboard band (2) and which is flanked to the second scissors (92); preferably, to form the eighth cut (28) (which can have the same shape as the eighth window (38)), the first cutting means comprise an eighth scissors (98) which acts on the second lateral end (7) of the cardboard band (2) and which is flanked to the fourth scissors (94).

The seventh scissors (97) and the eighth scissors (98) can have the same characteristics and functionality as the first scissors (91), the second scissors (92), the third scissors (93), the fourth scissors (94), the fifth scissors (95) and the sixth scissors (96) already discussed in the foregoing.

In a variant of the apparatus, illustrated in FIG. 18, to form the seventh cut (27) (which can have the same shape as the seventh window (37)) and the eighth cut (28) (which can have the same shape as the eighth window (38)) it is possible to use respectively the first guillotine (121) and the second guillotine (122).

The method preferably comprises further steps of: making a third score line (13) on the first lateral sector (4) of the band which is parallel to the extension direction, such that a first portion (101) of band is identified in the first closing wing (49), comprised between the first score line (11) and the third score line (13) and a second portion (102) of band is identified in the first closing wing (49), comprised between the third score line (13) and the free end of the first closing wing (49), the position of the third score line (13) being selected in such a way that the extension of the first portion (101) of band, measured along a perpendicular direction to the development direction, is in relation with the height of a first flank (41) of an article (9) to be packed which is resting on the central sector (3), between the first closing wing (49) and the second closing wing (50), the first flank (41) being exposed towards the first closing wing (49); realising a fourth score line (14) on the second lateral sector (5) of the band which is parallel to the extension direction, such that a third portion (103) of band is identified in the second closing wing (50) comprised between the second score line (12) and the fourth score line (14) and a fourth portion (104) of band is identified in the second closing wing (50) comprised between the fourth score line (14) and the free end of the second closing wing (50), the position of the fourth score line (14) being selected such that the extension of the third portion (103) of band, measured along a perpendicular direction to the extension direction, is in height relation with a second flank (42) of the article (9) to be packed which is resting on the central sector (3) between the first closing wing (49) and the second closing wing (50), the second flank (42) being exposed towards the second, closing wing (50).

The extension of the first portion (101) of band, measured along a perpendicular direction to the development direction, is preferably greater than or equal to (preferably equal to) the height of the first flank (41) of the article (9) to be packed; the extension of the third portion (103) of band, measured along a perpendicular direction to the development direction, is greater than or equal to (preferably equal to) the height of the second flank (42) of the article (9) to be packed.

When the first closing wing (49) is folded towards the central sector (3) so as to wrap the first flank (41) and the third part of the upper side of the article (9) resting on the central sector (3), the first portion (101) of band, which is hinged to the first score line (11), rotates by an angle (preferably 90°) with respect to the central sector (3) on which the article (9) is resting, while the second portion (102) of band, which is hinged to the third score line (13), rotates by an angle (preferably) 90° with respect to the first portion (101) of band so as to cover the third part of the upper side of the article (9).

Therefore, the third score line (13) facilitates the folding of the first closing wing (49) so as to wrap the first flank (41) and the third part of the upper side of the article (9) to be packed, resting on the central sector (3) between the first closing wing (49) and the second closing wing (50).

When the second closing wing (50) is folded towards the central sector (3) to wrap the second flank (42) and the fourth part of the upper side of the article (9) resting on the central sector (3), the third portion (103) of band, which is hinged to the second score line (12), rotates by an angle (preferably 90°) with respect to the central sector (3) on which the article (9) is resting, while the fourth portion (104) of band, which is hinged to the fourth score line (14), rotates by an angle (preferably 90°) with respect to the third portion (103) of band to cover the fourth part of the upper side of the article (9).

Therefore, the fourth score line (14) facilitates the folding of the second closing wing (50) to wrap the second flank (42) and the fourth part of the upper side of the article (9) to be packed, resting on the central sector (3) between the first closing wing (49) and the second closing wing (50).

The scoring means preferably further comprise: a third scoring wheel (73) preferably borne by the first shaft (70), which third scoring wheel (73) is rotatable with respect to the axis thereof so as to realize the third score line (13); a fourth scoring wheel (74) preferably borne by the first shaft (70), which fourth score line (74) is rotatable with respect to the axis thereof so as to realize the fourth score line (14). The first shaft (70), the third scoring wheel (73) and the fourth scoring wheel (74) are arranged with respect to the underlying advancing cardboard band (2) so as to realize the third score line (13) and the fourth score line (14).

The scoring means can further comprise: a fifth support (85) which is constrained to the first shaft (70) and which bears in turn the third scoring wheel (73); a sixth support (86) which is constrained to the first shaft (70) and which in turn bears the fourth scoring wheel (74).

The third scoring wheel (73) and the fourth scoring wheel (74) are preferably drawn in rotation by actuators (not illustrated).

The position of the third score line (13) and the fourth score line (14) can be regulated in accordance with the dimensions of the article (9) to be packed; for this purpose, it is possible to regulate the positions of the third scoring wheel (73) and the fourth scoring wheel (74) along the first shaft (70).

The fifth support (85) and the sixth support (86) can therefore be carriages able to slide along the first shaft (70) (which functions as a sliding guide) so that the third scoring wheel (73) and the fourth scoring wheel (74) can easily translate along the third score line (13) and the fourth score line (14) according to the dimensions of the article (9) to be packed.

In a case in which it is necessary to vary the positions of the third score line (13) and the fourth score line (14) in passing from a first region of band (R1) to a successive second region of band (R2) (FIG. 2), the first shaft (70), the third scoring wheel (73) and the fourth scoring wheel (74) can be translated when the band is stationary.

The method preferably comprises further steps of: realising a fifth score line (15) on the first lateral sector (4) of the band which is parallel to the extension direction and comprised between the first score line (11) and the third score line (13), such that a fifth portion (105) of band is identified in the first portion (101) of band, comprised between the first score line (11) and the fifth score line (15) and a sixth portion (106) of band is identified in the first portion (101) of band comprised between the fifth score line (15) and the third score line (13), the positions of the third score line (13) and the fifth score line (15) being selected such that it is in particular the extension of the sixth portion (106) of band, measured along a perpendicular direction to the extension direction, that is in relation with the height of the first flank (41) of the article (9) to be packed; realising a sixth score line (16) on the second lateral sector (5) of the belt that is parallel to the extension direction and comprised between the second score line (12) and the fourth score line (14), such that a seventh portion (107) of band is identified in the third portion (103) of band comprised between the second score line (12) and the sixth score line (16) and an eighth portion (108) of band is identified in the third portion (103) of band comprised between the sixth score line (16) and the fourth score line (14), the positions of the fourth score line (14) and the sixth score line (16) being selected such that it is in particular the extension of the eighth portion (108) of band, measured along a perpendicular direction to the extension direction, that is in relation with the height of the second flank (42) of the article (9) to be packed.

The first closing wing (49) is preferably foldable to wrap the first flank (41) and the third part of the upper side of the article (9) resting on the central sector (3), between the first closing wing (49) and the second closing wing (50), so that: the fifth portion (105) of band, hinged to the first score line (11) rotates by an angle, preferably 180°, so as to adhere to the central sector (3); the sixth portion (106) of band, hinged to the fifth score line (15), rotates by an angle, preferably 90°, with respect to the central sector (3) and the fifth portion (105) of band so as to wrap the first flank (41) of the article (9), the second portion (102) of band, hinged to the third score line (13), rotates by an angle, preferably of 90°, with respect to the sixth portion (106) of band so as to wrap the third part of the upper side of the article (9) to be wrapped.

Therefore, the fifth portion (105) of band superposes on the central sector (3), arranging itself parallel thereto and forming a first reinforced edge (89) (FIGS. 13A, 13B, 14, 15, 16, 17A, 17B) which further protects the article (9) once the wrapping has been completed, from impacts and accidental falls.

The second closing wing (50) is preferably foldable to wrap the second flank (42) and the fourth part of the upper side of the article (9) resting on the central sector (3), between the first closing wing (49) and the second closing wing (50), so that: the seventh portion (107) of band, hinged to the second score line (12), rotates by an angle, preferably 180°, so as to adhere to the central sector (3); the eighth portion (108) of band, hinged to the sixth score line (16), rotates by an angle, preferably 90°, with respect to the central sector (3) and the seventh portion (107) of band so as to wrap the second flank (42) of the article (9); the fourth portion (104) of band, hinged to the fourth score line (14), rotates by an angle, preferably of 90°, with respect to the eighth portion (108) of band so as to wrap the fourth part of the upper side of the article (9) to be packed.

Therefore, the seventh portion (107) of band superposes on the central sector (3), arranging itself parallel thereto and forming a second reinforced edge (90) (FIGS. 13A, 13B, 14, 15, 16, 17A, 17B) which further protects the article (9) once the wrapping has been completed, from impacts and accidental falls.

The scoring means preferably further comprise: a fifth scoring wheel (75) borne by the first shaft (70), which fifth scoring wheel (75) is rotatable with respect to an axis thereof such as to realise a fifth score line (15); a sixth scoring line wheel (76) borne by the first shaft (70), which sixth scoring wheel line (76) is rotatable with respect to an axis thereof such as to realise a sixth score line (16). The first shaft (70), the fifth scoring wheel (75) and the sixth scoring wheel (76) are arranged with respect to the underlying band of carton (2) in advancement so as to realise the fifth score line (15) and the sixth score line (16).

The scoring means can further comprise: a seventh support (87) which is constrained to the first shaft (70) and which in turn bears the fifth scoring wheel (75); an eighth support (88) which is constrained to the first shaft (70) and which in turn bears the sixth scoring wheel (76).

The fifth scoring wheel (75) and the sixth scoring wheel (76) are preferably drawn in rotation by actuators (not illustrated).

The position of the fifth score line (15) and the sixth score line (16) can be regulated according to the position of the article (9) to be packed; for this purpose, the positions of the fifth scoring line (75) and the sixth scoring line (76) along the first shaft (70) can be regulated.

The seventh support (87) and the eighth support (88) can therefore be carriages able to slide along the first shaft (70) (which functions as a sliding guide) so that the fifth scoring wheel (75) and the sixth scoring wheel (76) can easily translate along the first shaft (70), enabling regulation of the positions of the fifth score line (15) and the sixth score line (16) in accordance with the dimensions of the article (9) to be packed.

In a case where the positions of the fifth score line (15) and the sixth score line (16) are to be varied, in passing from a first region of band (R1) and a successive second region of band (R2), the first shaft (70), the fifth scoring wheel (75) and the sixth scoring wheel (76) can be translated when the band is stationary.

The apparatus (10) can comprise means for applying glue (48) which are arranged at the second cutting means (39), which release two strips of glue (109) on the central sector (3), in proximity respective of the first score line (11) and the second score line (12). The two strips of glue (109) lead to cementing: of the fifth reinforcing wing (55), the sixth reinforcing wing (56), the seventh reinforcing wing (57), the eighth reinforcing wing (58), the ninth reinforcing wing (59), the tenth reinforcing wing (60), the eleventh reinforcing wing (99), the twelfth reinforcing wing (100), the fifth portion (105) of band and the seventh portion (107) of band at the central sector (3).

The apparatus (10) is part of a system, illustrated in FIG. 1, for packing articles (9).

The above has been described by way of non-limiting example, and any constructional variants are understood to fall within the protective field of the present technical solution, as claimed in the following.

The invention claimed is:

1. A method for forming a packing cartons in accordance with dimensions of an article to be packed and for wrapping or enclosing the article in the packing carton, comprising:

arranging, on a conveyor, the article to be packed;

acquiring by a television camera dimensions of the article;

unwinding a cardboard band from a reel;

feeding the cardboard band along an advancement direction;

making a first longitudinal score line and a second longitudinal score line on the cardboard band, such that the first longitudinal score line and the second longitudinal score line are parallel to the advancement direction and the following are identified: a central sector comprised between the first longitudinal score line and the second longitudinal score line;

a first lateral sector comprised between the first longitudinal score line and a first lateral end of the cardboard band; and a second lateral sector comprised between the second longitudinal score line and a second lateral end of the cardboard band which is opposite the first lateral end, wherein the position and distance between the first longitudinal score line and the second longitudinal score line are chosen according to the acquired dimensions of the article to be packed so that the article to be packed can be placed resting on the central sector between the first longitudinal score line and the second longitudinal score line and so that the first longitudinal score line and second longitudinal score line are symmetrical with respect to a longitudinal axis of the cardboard band, with the first lateral sector and the second lateral sector being identical;

making in the cardboard band a first transverse cut, a second transverse cut, a third transverse cut and a fourth transverse cut such that: the first transverse cut and the second transverse cut are made in the first lateral sector and extend up to the first longitudinal score line, such that a first closing wing, a first reinforcing wing and a second reinforcing wing are defined in the first lateral sector, the first closing wing being interposed between the first reinforcing wing and the second reinforcing wing; the third transverse cut and the fourth transverse cut are made in the second lateral sector and extend up to the second longitudinal score line, such that a second closing wing, a third reinforcing wing and a fourth reinforcing wing are defined on the second lateral sector, the second closing wing being interposed between the third reinforcing wing and the fourth reinforcing wing; the first closing wing is opposite the second closing wing, the first reinforcing ring is opposite the third reinforcing wing, the second reinforcing wing is opposite the fourth reinforcing wing;

cutting the cardboard band transversely such as to separate and obtain a packing carton for packing the article;

taking the article from the conveyor and placing the article resting on the central sector between the first closing wing and the second closing wing;

folding the first closing wing towards the central sector by rotating the first closing wing with respect to the first longitudinal score line to wrap or cover a first flank of the article;

folding the second closing wing towards the central sector by rotating the second closing wing with respect to the second longitudinal score line to wrap or cover a second flank of the article opposite to the first flank;

folding the first reinforcing wing and folding the third reinforcing wing towards a first portion of the central sector, the first reinforcing wing, the third reinforcing wing and the first portion of the central sector, on which the first reinforcing wing and third reinforcing wing are folded, forming a first superposing group, and folding the first superposing group to wrap or cover a third flank of the article between the first flank and the second flank;

folding the second reinforcing wing and the fourth reinforcing wing towards a second portion of the central sector, the second reinforcing wing, the fourth reinforcing wing and the second portion of the central sector, on which the second reinforcing wing and the fourth reinforcing wing are folded, forming a second superposing group, and folding the second superposing group to wrap or cover a fourth flank of the article opposite to the third flank.

2. The method of claim 1, comprising, before placing the article resting on the central sector between the first closing wing and the second closing wing, cutting an edge strip of the cardboard band which is located at the first lateral end of the cardboard band and cutting an edge strip of the cardboard which is located at the second lateral end of the cardboard band as a function of the dimensions of the article to be packed.

3. The method of claim 1, wherein before placing the article resting on the central sector between the first closing wing and the second closing wing, the following are further carried out: a fifth transverse cut is made in the cardboard band such as to divide the first reinforcing wing into two parts including a fifth reinforcing wing and a sixth reinforcing wing; a sixth transverse cut is made in the cardboard band such as to divide the third reinforcing wing into two parts including a seventh reinforcing wing and an eighth reinforcing wing; the fifth reinforcing wing being opposite the seventh reinforcing wing and the sixth reinforcing wing being opposite the eighth reinforcing wing; the positions of the fifth transverse cut and the sixth transverse cut being selected such that the extensions of the sixth reinforcing wing and the eighth reinforcing wing, measured along the advancement direction, are in relation to the height of a third flank of an article to be packed which is resting on the central sector, between the first closing wing and the second closing wing, the third flank being exposed towards the tract of central sector to which are hinged, by the first longitudinal score line and the second longitudinal score line, the fifth reinforcing wing, the sixth reinforcing wing, the seventh reinforcing wing and the eighth reinforcing wing.

4. The method of claim 1, wherein before placing the article resting on the central sector between the first closing wing and the second closing wing the following are further realized: a seventh transverse cut is made transversely to the cardboard band such as to divide the second reinforcing wing into two parts, a ninth reinforcing wing and a tenth reinforcing wing; an eighth transverse cut is made transversely to the cardboard band such as to divide the fourth reinforcing wing into two parts, an eleventh reinforcing wing and a twelfth reinforcing wing; the ninth reinforcing wing being opposite the eleventh reinforcing wing and the tenth reinforcing wing being opposite the twelfth reinforcing wing; the positions of the seventh transverse cut and the eighth transverse cut being selected such that the extensions of the ninth reinforcing wing and the eleventh reinforcing wing, measured along the advancement direction, are in relation with the height of a fourth flank of an article to be packed which is resting on the central sector, between the first closing wing and the second closing wing, the fourth flank being exposed towards the tract of central sector to which are hinged, by the first longitudinal score line and the second longitudinal score line, the ninth reinforcing wing, the tenth reinforcing wing, the eleventh reinforcing wing and the twelfth reinforcing wing.

5. The method of claim 1, further comprising: making a third longitudinal score line on the first lateral sector of the cardboard band which is parallel to the advancement direction, such that a first portion of cardboard band is identified in the first closing wing, comprised between the first longitudinal score line and the third longitudinal score line and a second portion of cardboard band is identified in the first closing wing, comprised between the third longitudinal score line and the free end of the first closing wing, the position of the third longitudinal score line being selected in such a way that the extension of the first portion of the cardboard band, measured along a perpendicular direction to the advancement direction, is in relation with the height of a first flank of an article to be packed which is resting on the central sector, between the first closing wing and the second closing wing, the first flank being exposed towards the first closing wing; forming a fourth longitudinal score line on the second lateral sector of the cardboard band which is parallel to the advancement direction, such that a third portion of the cardboard band is identified in the second closing wing comprised between the second longitudinal score line and the fourth longitudinal score line and a fourth portion of the cardboard band is identified in the second closing wing comprised between the fourth longitudinal score line and the free end of the second closing wing, the position of the fourth longitudinal score line being selected such that the extension of the third portion of the cardboard band, measured along a perpendicular direction to the advancement direction, is in height relation with a second flank of the article to be packed which is resting on the central sector between the first closing wing and the second closing wing, the second flank being exposed towards the second closing wing.

6. The method of claim 5, further comprising: forming a fifth longitudinal score line on the first lateral sector of the cardboard band which is parallel to the advancement direction and comprised between the first longitudinal score line and the third longitudinal score line, such that a fifth portion of the cardboard band is identified in the first portion of the cardboard band comprised between the first longitudinal score line and the fifth longitudinal score line and a sixth portion of the cardboard band is identified in the first portion of the cardboard band comprised between the fifth longitudinal score line and the third longitudinal score line, the positions of the third longitudinal score line and the fifth longitudinal score line being selected such that the extension of the sixth portion of the cardboard band, measured along a perpendicular direction to the advancement direction, is in relation with the height of the first flank of the article to be packed; forming a sixth longitudinal score line on the second lateral sector of the cardboard band that is parallel to the advancement direction and comprised between the second longitudinal score line and the fourth longitudinal score line, such that a seventh portion of the cardboard band is identified in the third portion of the cardboard band comprised between the second longitudinal score line and the sixth longitudinal score line and an eighth portion of the cardboard band is identified in the third portion of the cardboard band comprised between the sixth longitudinal score line and the fourth longitudinal score line, the positions of the fourth longitudinal score line and the sixth longitudinal score line being selected such that the extension of the eighth portion of the cardboard band, measured along a perpendicular direction to the advancement direction, is in relation with the height of the second flank of the article to be packed.

* * * * *